United States Patent [19]

Okamoto et al.

[11] Patent Number: 4,882,964

[45] Date of Patent: Nov. 28, 1989

[54] PERCUSSIVE MUSICAL TONE GENERATOR SYSTEM

[75] Inventors: Eisaku Okamoto; Ikuo Komatsu, both of Shizuoka, Japan

[73] Assignee: Yamaha Corporation, Hamamatsu, Japan

[21] Appl. No.: 199,321

[22] Filed: May 26, 1988

[30] Foreign Application Priority Data

May 27, 1987 [JP] Japan ..... 62-130240
May 27, 1987 [JP] Japan ..... 62-130241
May 27, 1987 [JP] Japan ..... 62-130242

[51] Int. Cl.[4] ..... G10H 1/42; G10H 7/00

[52] U.S. Cl. ..... 84/611; 84/DIG. 2; 84/DIG. 12; 84/618; 307/231; 328/137; 328/154; 340/825.51

[58] Field of Search ..... 84/1.01, 1.03, DIG. 2, 84/DIG. 12; 340/365.5, 825.5, 825.51; 307/231; 328/137, 154; 341/20, 22, 26

[56] References Cited

U.S. PATENT DOCUMENTS 4,041,826 8/1977 Oya .
4,114,495 9/1978 Tomisawa .
4,467,690 8/1984 Nishimoto .

FOREIGN PATENT DOCUMENTS 59-18471 5/1984 Japan .

*Primary Examiner*—Stanley J. Witkowski

*Attorney, Agent, or Firm*—Burns, Doane, Swecker & Mathis

[57] ABSTRACT

In a musical tone generator system, rhythm pattern data are read out from a rhythm pattern memory so that the formation of the tone signal specified by the rhythm pattern data is controlled by allocating the tone signal to one of the tone signal forming channels of a signal forming circuit, which is thus enabled to output from each of the tone signal forming channels the tone signal specified by the rhythm pattern data with the result that a sequence of tones is automatically generated in accordance with the rhythm pattern data. When any one of the tone select keys is activated, the formation of the tone signal corresponding to the tone designated by the activated tone select key is controlled by allocating the tone signal to one of the tone signal forming channels. The tone signal forming circuit is now enabled to form in and output from each of the tone signal forming channels a tone signal which corresponds to the tone designated by the activated tone select key. Thus, the tone signal forming circuit generates a sequence of tones with an automatically controlled rhythm pattern and the tone designated by the activated tone select key. The allocation of the tone signal corresponding to the tone designated by the activated tone select key and the tone signal specified by the rhythm pattern data is controlled so that the former is allocated to one of the tone signal forming channels preferentially over the latter.

18 Claims, 11 Drawing Sheets

PERCUSSIVE MUSICAL TONE GENERATOR SYSTEM

FIELD OF THE INVENTION

The present invention relates to a musical tone generator system capable of generating a sequence of musical tones in a rhythm pattern determined in accordance with a rhythm pattern data fetched from a rhythm pattern memory accompanied by generation of musical tones designated from manually operated tone select keys.

BACKGROUND OF THE INVENTION

An example of a prior-art musical tone generator system of the type to which the present invention generally appertains is disclosed in Japanese Utility Model Specification No. 59-18471. The musical tone generator system therein taught includes a plurality of percussive tone source circuits which correspond in number to the percussive tones of different types of percussion instruments available. Pulses representative of rhythm tones of different ones of the percussion instruments are read out at predetermined timings from a rhythm pattern memory and are respectively supplied to these percussive tone source circuits each via one input terminal of an OR gate. To the other input terminal of each of the OR gates thus respectively associated with the percussive tone source circuits pulses produced with tone select keys manually activated on the control board of the system. Not only the rhythm tones dictated by the data read from the rhythm pattern memory are generated in an automatic fashion but the percussive tones selected by the player manipulating the control board can be generated by this type of musical tone generator system.

Another example of a known musical tone generator system of the type with which the present invention is concerned is disclosed in U.S. Pat. No. 4,467,690. In the musical tone generator system disclosed therein are provided percussive tone source circuits which are smaller in number than the tones of the percussion instruments available. The number of the kinds of percussive tones to be generated for each of the rhythm patterns for march, waltz and so forth is limited to be equal to the number of the percussive tone source circuits provided in the system. Pulses representative of different kinds of rhythm tones are respectively supplied to these percussive tone source circuits to generate tones of different percussion instruments for each of the rhythm patterns used.

A prior-art musical tone generator system of the former type has a drawback in that it is required to provide percussive tone source circuits which are equal in number to the kinds of percussive tones available. It being desirable that there are available tones of as large number of types of percussion instruments as possible, provision of such a number of percussive tone source circuit results in an increase in the production cost of the system.

Such a drawback is eliminated in a known musical tone generator system of the latter type in which the number of the percussive tone source circuits may be less than the number of the kinds of percussive tones available. In this type of prior-art musical tone generator system, however, a problem is encountered when the player desires to add musical tones to a sequence of tones automatically generated in a given rhythm pattern. Tones of only a limited number of percussion instruments being available, the player may not be permitted to use his desired kinds of tones.

The present invention contemplates elimination of these drawbacks of known types of musical tone generator system. It is, accordingly, an important object of the present invention to reduce the production cost and provide an increased range of selection of percussive tones in a musical tone generator system capable of generating a sequence of musical tones in a rhythm pattern determined in accordance with a rhythm pattern data fetched from a rhythm pattern memory accompanied by generation of musical tones designated from manually operated tone select keys.

A third type of known musical tone generator system is taught in U.S. Pat. No. 4,041,826. In the musical tone generator system disclosed therein, the individual tone select keys on the control board are respectively allocated to different tone signal forming channels. Each time a tone select key is manually depressed and thereafter released and accordingly a tone is generated and then attenuated, counts produced in conjunction with the tone signal forming channels corresponding to the tone select keys which have already been released from manipulative efforts are incremented indiscriminately for these channels. The order in which the tone select keys have been released can thus be indicated by the respective counts for the individual signal forming channels. The counts for the tone signal forming channels are then compared together to detect the channel associated with the largest count and accordingly corresponding to the earliest activated tone select key. A newly activated tone select key is allocated to the channel thus detected so that the tone designated by the newly activated tone select key is to be generated through this particular tone signal forming channel.

There is a fourth type of prior-art musical tone generator system, an example of which is disclosed in U.S. Pat. No. 4,114,495. In the musical tone generator system proposed therein, envelopes are produced for the control of volume levels of the tones to be generated through different tone signal forming channels. From among these signal forming channels, the channel corresponding to the volume control envelope having the smallest amplitude indicating the lowest volume level is detected. A newly activated tone select key is allocated to the signal forming channel thus detected so that the tone designated by the newly activated tone select key is to be generated through this particular tone signal forming channel.

A prior-art musical tone generator system of the third type has a drawback which results from the fact that tone select keys newly activated are allocated to any of the tone signal forming channels in an order in which the tone select keys have been released from manipulative efforts. Such an order being irrespective of the attenuation periods viz., the durations of tones generated, a problem arises which is however not encountered when the tones concurrently generated have equal attenuation periods. The problem is that, when tones including a tone having a relatively short attenuation period and a tone having a relatively long attenuation period are to be generated simultaneously, generation of the tone having the long attenuation period may be terminated earlier than the tone having the short attenuation period although the generation of the tone having the long attenuation period is incomplete. For this reason, the prior-art musical tone generator system of the third type is not suitable for the concurrent generation of different kinds of musical tones.

A drawback in a conventional musical tone generator system of the fourth type is that provision of some extra circuits are required. Such additional circuits include a circuit to search for the channel corresponding to the volume control envelope having the smallest amplitude indicating the lowest volume level is detected, a circuit for detecting the amplitude of the volume control envelope and producing a signal indicative of the detected amplitude, and a circuit for transferring the signal to the channel allocation control circuit. The provision of these extra circuits will significantly add to the production cost of the system.

It is accordingly a second important object of the present invention to reduce the production cost and enable improved channel allocation of percussive tones in a musical tone generator system capable of generating a sequence of musical tones in a rhythm pattern determined in accordance with a rhythm pattern data fetched from a rhythm pattern memory accompanied by generation of musical tones designated from manually operated tone select keys.

In a prior-art musical tone generator system of the type disclosed in Japanese Utility Model Specification No. 59-18471 as previously mentioned, there is another problem that, when percussive tones are generated by manipulation of the tone select keys with the automatically controlled mode of rhythmation selected, tones are generated with the automatically controlled rhythmation in addition to the tones resulting from the manipulation of the tone select keys. Thus, the player of the system is not permitted to introduce tones with manually controlled rhythmation into the sequence of tones being generated with the automatically controlled rhythmation. Such a problem could be solved if switches to start and terminate the automatically controlled rhythmation are manipulated to interrupt the automatically controlled mode of rhythmation to enable the player to produce tones through manipulation of the tone select keys. This however imposes added burdens on the player in manipulating the switches in addition to the tone select keys. A further object of the present invention is to provide a musical tone generator system free from this problem.

SUMMARY OF THE INVENTION

In accordance with a first important aspect of the present invention, there is provided a musical tone generator system comprising a rhythm pattern memory having stored therein rhythm pattern data representative of a plurality of different rhythm patterns for automatically generating a plurality of musical tones in a selected one of the rhythm patterns, pattern data readout means for reading the rhythm pattern data from the rhythm pattern memory successively for the different rhythm patterns at predetermined timings, a plurality of tone select keys respectively corresponding to the plurality of musical tones each for producing a signal instructing the generation of the tone to which the tone select key corresponds, tone signal forming means having a plurality of tone signal forming channels, the tone signal forming means being operative to form in and output from each of the tone signal forming channels a tone signal which is specified by the rhythm pattern data read out by the data readout means or which corresponds to the tone designated by a manually activated one of the tone select keys, tone signal allocating means for controlling the formation of the tone signal specified by the rhythm pattern data read out by the data readout means or corresponding to the tone designated by the activated one of the tone select keys by allocating the tone signal to one of the tone signal forming channels, and allocation priority control means for controlling the allocation of the tone signal corresponding to the tone designated by the activated one of the tone select keys and the tone signal specified by the rhythm pattern data read out by the data readout means so that the former is allocated to one of the tone signal forming channels preferentially over the latter.

In accordance with a second important aspect of the present invention, there is provided a musical tone generator system comprising tone generation instructing means operable for instructing selective generation of a plurality of different kinds of musical tones, tone signal forming means having a plurality of tone signal forming channels, the tone signal forming means being operative to form in and output from each of the tone signal forming channels a tone signal which corresponds to the tone designated by a manually activated one of the tone select keys, tone signal allocating means for controlling the formation of the tone signal corresponding to the tone designated by the activated one of the tone select keys by allocating the tone signal to one of the tone signal forming channels, time measuring means respectively corresponding to the tone signal forming channels for measuring the residual time duration for which the generation of the tone being generated under the control of the tone signal is to be continued, the residual time duration being measured for each of the different kinds of musical tones, and allocation control means for controlling the allocation of the tone signal corresponding to the tone designated by the activated one of the tone select keys, the allocation of the tone signal being controlled on the basis of the residual time duration measured by the time measuring means.

In accordance with a third important aspect of the present invention, there is provided a rhythm tone generator system comprising rhythm pattern data generating means for outputting rhythm pattern data successively at predetermined timings, the rhythm pattern data being representative of a plurality of different rhythm patterns of a plurality of musical tones to be automatically generated, percussive tone signal forming means responsive to the rhythm pattern data output from the rhythm pattern data generating means for forming percussive tone signals dictated by the rhythm pattern data received, a plurality of tone select keys respectively corresponding to the plurality of musical tones each for producing a signal instructing the generation of the tone to which the tone select key corresponds, tone select key detecting means for detecting the respective states of the tone select keys and producing signals representative of the detected states of the tone select keys, signal output means for outputting the signals from the tone select key detecting means to the percussive tone signal forming means for controlling the formation of the percussive tone signals, signal output inhibiting means responsive to the signals from the tone select key detecting means for inhibiting the rhythm pattern data generating means from outputting the rhythm pattern data if the rhythm pattern data generating means is in the process of outputting the rhythm pattern data, and inhibition disabling means for disabling the signal output inhibiting means at predetermined timings.

In accordance with a fourth important aspect of the present invention, there is provided a rhythm tone generator system comprising rhythm pattern data generating means for outputting rhythm pattern data successively at predetermined timings, the rhythm pattern data being representative of a plurality of different rhythm patterns of a plurality of musical tones to be automatically generated, percussive tone signal forming means responsive to the rhythm pattern data output from the rhythm pattern data generating means for forming percussive tone signals dictated by the rhythm pattern data received, a plurality of tone select keys respectively corresponding to the plurality of musical tones each for producing a signal instructing the generation of the tone to which the tone select key corresponds, tone select key detecting means for detecting the respective states of the tone select keys and producing signals representative of the detected states of the tone select keys, signal output means for outputting the signals from the tone select key detecting means to the percussive tone signal forming means for controlling the formation of the percussive tone signals, signal output inhibiting means responsive to the signals from the tone select key detecting means for inhibiting the rhythm pattern data generating means from outputting the rhythm pattern data if the rhythm pattern data generating means is in the process of outputting the rhythm pattern data, inhibition disabling means for disabling the signal output inhibiting means at predetermined timings, and inhibition disable cancelling means for cancelling the disabled state of the signal output inhibiting means when a signal is produced from the signal output means with the signal output inhibiting means held in the disabled state.

In accordance with a fifth important aspect of the present invention, there is provided a rhythm tone generator system comprising rhythm pattern data generating means for outputting rhythm pattern data successively at predetermined timings, the rhythm pattern data being representative of a plurality of different rhythm patterns of a plurality of musical tones to be automatically generated, percussive tone signal forming means responsive to the rhythm pattern data output from the rhythm pattern data generating means for forming percussive tone signals dictated by the rhythm pattern data received, a plurality of tone select keys respectively corresponding to the plurality of musical tones each for producing a signal instructing the generation of the tone to which the tone select key corresponds, tone select key detecting means for detecting the respective states of the tone select keys and producing signals representative of the detected states of the tone select keys, signal output means for outputting the signals from the tone select key detecting means to the percussive tone signal forming means for controlling the formation of the percussive tone signals, signal output inhibiting means responsive to the signals from the tone select key detecting means for inhibiting the rhythm pattern data generating means from outputting the rhythm pattern data if the rhythm pattern data generating means is in the process of outputting the rhythm pattern data, inhibition disabling means for disabling the signal output inhibiting means at predetermined timings, and inhibition disable cancelling means which, when a signal is produced from the signal output means, inhibits the signal output means from outputting a signal if the rhythm pattern data generating means is in the process of outputting the rhythm pattern data.

BRIEF DESCRIPTION OF THE DRAWINGS

The features and advantages of a musical tone generator system according to the present invention will be more clearly appreciated from the following description taken in conjunction with the accompanying drawings in which in which.

DESCRIPTION OF THE PREFERRED EMBODIMENT

Figure 1:
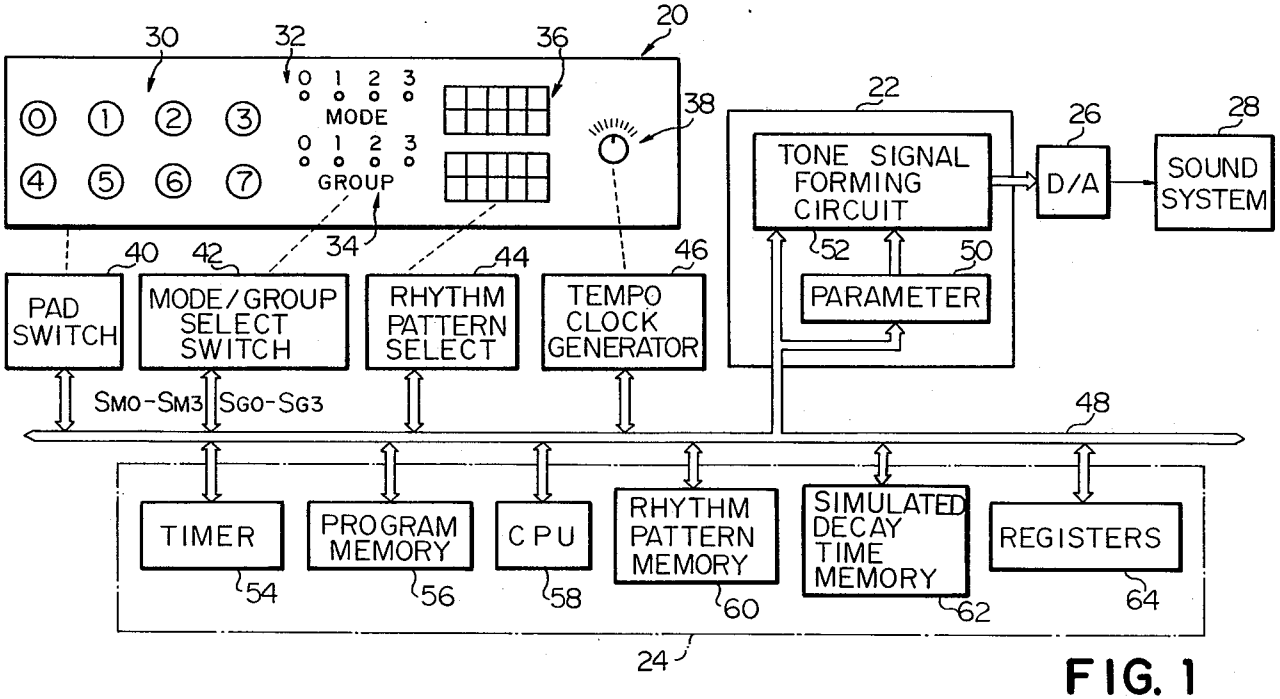
FIG. 1 is a block diagram showing the general construction and arrangement of a musical tone generator system to which the present invention appertains.

Referring to FIG. 1 of the drawings, a musical tone generator system embodying the present invention largely comprises a control board 20, a tone signal generator circuit 22 and a microcomputer 24. The tone signal generator circuit 22 is operative to produce digital tone signals designating tones of any of different percussion instruments such as for example a bass drum, a snare drum, high-hat cymbals, a tom-tom, and a conga. The microcomputer 24 is responsive to signals generated in and supplied from the control board 20 and control the operation of the tone signal generator circuit 22 on the basis of the signals received from the control board 20. The digital tone signals produced by the tone signal generator circuit 22 are converted into analog signals by a digital-to-analog converter 26 (D/A) and the resultant analog tone signals are supplied to a sound generator system 28 to generate the tones respectively designated by the supplied tone signals. There are available a total of thirty two different percussive tones which are grouped into four tone groups 0 to 3 each composed of percussive tones of eight different types of percussion instruments.

On the control board 20 are provided eight tone-select pad key 30, four mode select keys 32, four group select keys 34, two sets of rhythm pattern select keys 36, and a tempo control knob 38. The tone-select pad key 30 are used to designate the percussive tones to be generated of the tone group selected by any of the mode select keys 32. Each of the tone groups 0 to 3 which can be selected by the mode select keys 32 is composed of eight different percussive tones which consist of tone 0 to tone 7 as shown. Thus, one of such eight percussive tones 0 to 7 of one of the tone groups 0 to 3 selected by any of the mode select keys 32 is designated by any of the tone-select pad key 30. These tone-select pad key 30 are connected to a tone select switch circuit 40 which comprises eight tone select switches respectively associated with the tone-select pad key 30 for producing tone signals representative of the percussive tones 0 to 7 allocated to the tone-select pad key 30, respectively.

The mode select keys 32 are used to select any of four different modes of playing operation available in the musical tone generator system according to the present invention. These four modes of playing operation consist of mode 0, mode 1, mode 2 and mode 3 which are as follows:

Mode 0 is used to terminate the automatically controlled rhythmation and allow generation of only the percussive tones designated by the tone-select pad key 30.

Mode 1 is used to allow generation of a sequence of percussive tones with an automatically controlled rhythm accompanied by generation of the percussive tones designated from any of the tone-select pad key 30.

Mode 2 is used to allow generation of a sequence of percussive tones with an automatically controlled rhythm but, when any of the tone-select pad key 30 are manually activated during generation of the sequence of percussive tones with the automatically controlled rhythm, terminate the generation of the sequence of percussive tones with the automatically controlled rhythm at the end of the current measure for thereafter allowing generation of only the percussive tones designated from any of the tone-select pad key 30.

Mode 3 is used during the mode 2 to inhibit generation of the percussive tone designated by the first activated one of the tone-select pad key 30.

On the other hand, the group select keys 34 are provided to designate the group of the percussive tones 0 to 7 which are to be designated from any of the tone-select pad key 30. The group select keys 34 are respectively assigned to the four groups of percussive tones, each group consisting of eight different percussive tones of eight different types of percussion instruments with a total of thirty two different percussive tones available by the four group select keys 34.

The mode select keys 32 and group select keys 34 are connected to a mode/group select switch circuit 42 which comprises four mode select switches respectively connected to the mode select keys 32 to produce signals $S_{M0}$, $S_{M1}$, $S_{M2}$ and $S_{M3}$ when the respectively associated ones of keys 32 are manually activated, and four group select switches respectively connected to the group select keys 34 to produce signals $S_{G0}$, $S_{G1}$, $S_{G2}$ and $S_{G3}$ when the respectively associated ones of keys 34 are manually activated. The rhythm pattern select keys 36 are used to select any of different rhythm patterns and are connected to a rhythm pattern select switch circuit 44 comprising rhythm pattern select switches respectively connected to the individual tone select keys 36. The tempo control knob 38 is used to vary the tempo of the automatically controlled rhythm and is connected to a tempo clock signal generator circuit 46 operative to produce a tempo clock signal having a frequency variable by the control knob 38.

The signals thus produced by the tone select circuit 40, mode/group select switch circuit 42, rhythm pattern select switch circuit 44 and tempo clock signal generator circuit 46 are supplied through a common bus 48 to the microcomputer 24.

The tone signal generator circuit 22 comprises a parameter memory 50 and a tone signal forming circuit 52. The parameter memory 50 has stored therein a set of parameter data to control the generation of the thirty two different percussive tones available and is operative to output such data under the control of the microcomputer 24. The tone signal forming circuit 52 has six tone signal forming channels 0 to 5 through each of which a digital tone signal is to be produced for the generation of a designated one of the thirty two different percussive tones. Such a tone signal is produced on the basis of data fetched from the parameter memory 50 under the control of the microcomputer 24 and is converted into an analog signal by the digital-to-analog converter 26. In response to the analog tone signal thus output from the digital-to-analog converter 26, the sound generator system 28, which is typically composed of an audio amplifier and a loud speaker, generates the tones designated by the supplied analog tone signals.

The microcomputer 24 comprises a timer unit 54, a program memory unit 56, a central processing unit 58, a rhythm pattern memory unit 60, a simulated decay time or channel keep interval memory 62, and a set of registers 64, all of which are connected together through the common bus 48. The timer unit 54 is operative to output timer interrupt signals to the central processing unit 58 in predetermined cycles of, for example, 50 milliseconds. The program memory unit 56 is implemented by a read-only memory (ROM) and has stored therein the routine and subroutine programs to be executed by the central processing unit 58. The routine and subroutine programs to be executed by the central processing unit 58 include a main routine program illustrated in the flowchart of FIG. 5, a timer interrupt routine program illustrated in the flowchart of FIG. 8, a tempo clock interrupt routine program illustrated in the flowchart of FIG. 9. The timer interrupt routine program is to be executed in response to a timer interrupt signal supplied from the timer unit 54 to request the central processing unit 58 to interrupt the execution of the main routine program. The tempo clock interrupt routine program is to be executed in response to a tempo clock signal supplied from the tempo clock signal generator circuit 46.

Figure 2A:
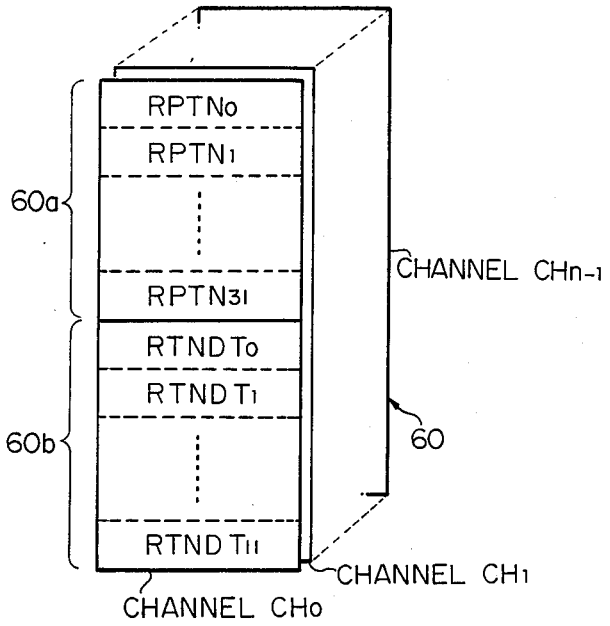
FIG. 2A is a schematic diagram showing the configuration of the pattern memory unit included in the microcomputer in the musical tone generator system illustrated in FIG. 1.
Figure 2B:
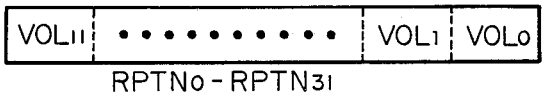
FIG. 2B is a schematic diagram showing the configuration of each set of rhythm pattern data stored in the pattern memory unit as shown in FIG. 2A.

The rhythm pattern memory unit 60 is also implemented by a read-only memory and has a plurality of pattern storage channels $CH_0$–$CH_5$ which corresponds to the six tone signal forming channels 0 to 5 provided in the tone signal forming circuit 52. Each of these pattern storage channels $CH_0$–$CH_5$ consists of a rhythm pattern data storage section 60*a* and a rhythm tone data storage section 60*b* as shown in FIG. 2A. Within the rhythm pattern data storage section 60*a* are stored thirty two sets of rhythm pattern data $RPTN_0$ to $RPTN_{31}$ for a single measure. These thirty two sets of rhythm pattern data $RPTN_0$ to $RPTN_{31}$ correspond to the tempo counts TCNT(0) to TCNT(31), respectively, to be described and, as shown in FIG. 2B, each consists of twelve pieces of two-bit sound volume data $VOL_0$ to $VOL_{11}$ representative of the volume levels for twelve different timbers, viz., the volume levels of the tones to be produced by twelve different types of percussion instruments, respectively. Each of these pieces of sound volume data $VOL_0$ to $VOL_{11}$ consists of two-bit data and may have a logic state "00" representative of a zero volume level or any of logic "01", "10" and "11" states which are representative of different first, second and third volume levels, respectively, for the timber or percussion instrument to which the particular sound volume data corresponds.

On the other hand, the rhythm tone data storage section 60*b* of each pattern storage channel $CH_0$ –$CH_n$ of the memory unit 60 has stored therein twelve pieces of rhythm tone data $RTND_0$ to $RTND_{11}$ representative of the pitch notations of the twelve different timbers, viz., the tones of the twelve different types of percussion instruments, respectively, to be used in producing the rhythm pattern represented by each of the thirty two sets of rhythm pattern data $RPTN_0$ to $RPTN_{31}$. These twelve pieces of rhythm tone data $RTND_0$ to $RTND_{11}$ correspond to the pieces of sound volume data $VOL_0$ to $VOL_{11}$ contained in each of the thirty two sets of rhythm pattern data $RPTN_0$ to $RPTN_{31}$.

Figure 3:
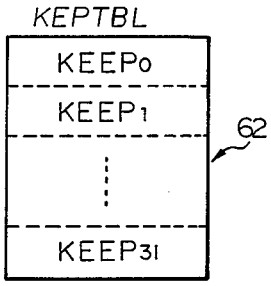
FIG. 3 is a schematic diagram showing the configuration of the time duration memory also included in the microcomputer in the musical tone generator system illustrated in FIG. 1.

The channel keep interval memory 62 is also implemented by a read-only memory and has stored therein thirty two pieces of channel keep interval data $KEEP_0$ to $KEEP_{31}$ in the form of table data, as shown in FIG. 3. The pieces of channel keep interval data $KEEP_0$ to $KEEP_{31}$ are indicative of the time durations required for the generation of the thirty two percussive tones, respectively, and are represented by the time intervals between the timer interrupt signals supplied from the timer unit 54. The time duration required for the generation of a percussive tone is herein defined as the period of time which intervenes between the time when the generation of the percussive tone is started and the time when the generation of the tone is terminated or nearly terminated.

Figures 4A, 4B:
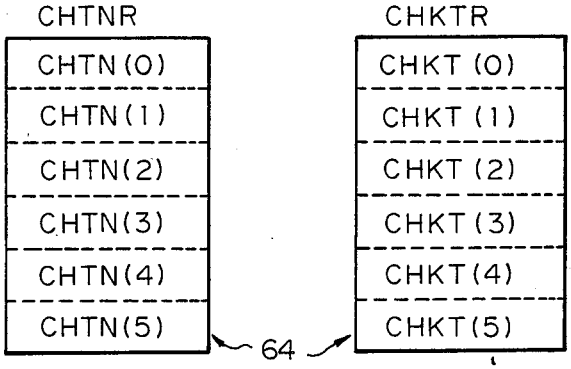
FIGS. 4A and 4B are diagrams showing the general arrangements of channel tone data registers (CHTNR) and channel duration data registers (CHKTR) included in the registers which implement a random access memory included the microcomputer in the musical tone generator system illustrated in FIG. 1.

The registers 64 are provided in the form of a random access memory and comprise a set of channel tone data registers CHTNR shown in FIG. 4A and a set of channel keep interval data registers CHKTR shown in FIG. 4B. The channel tone data registers CHTNR shown in FIG. 4A have stored therein six pieces of channel tone data CHTN(0) to CHTN(5) which correspond to the six tone signal forming channels, respectively, of the tone signal forming circuit 52. These pieces of channel tone data CHTN(0) to CHTN(5) are representative of the percussive tones to be generated in response to the digital tone signals transmitted through the tone signal forming channels of the circuit 52. The channel keep interval data registers CHKTR shown in FIG. 4B have stored therein pieces of channel keep interval data CHKT(0) to CHKT(5) which also correspond to the six tone signal forming channels 0 to 5, respectively, of the tone signal forming circuit 52. These pieces of channel keep interval data CHKT(0) to CHKT(5) are representative of the respective time durations for which percussive tones are to be generated in response to the tone signals transmitted through the tone signal forming channels of the tone signal forming circuit 52.

The registers 64 provided in the microcomputer 24 further comprise those which have the following data stored therein:

Old pad-key data $PAD_{OLD}$ which is an eight-bit data representative of the respective old states of the eight tone-select pad key 30 with the activated state of each tone-select pad key indicated by a logic "1" bit and the de-activated state of each tone-select pad key indicated by a logic "0" bit.

New pad-key data $PAD_{NEW}$ which is an eight-bit data representative of the respective new states of the eight tone-select pad key 30 with the activated state of each tone-select pad key indicated by a logic "1" bit and the de-activated state of each tone-select pad key indicated by a logic "0" bit.

Old mode data $MODE_{OLD}$ representative of any of the four modes 0 to 3 previously selected by one of the mode select keys 32.

New mode data $MODE_{NEW}$ representative of any of the four modes 0 to 3 newly selected by one of the mode select keys 32.

Tone group data GRP representative of any of the four tone groups 0 to 3 currently selected by one of the group select keys 34.

Tempo count TCNT representative the current state of progress of the rhythm currently in use, incremented by one from a "0" value to a "31" value each time a tempo clock signal is output from the tempo clock signal generator circuit 46.

Rhythm break flag BRF effective during any of the modes 1 to 3 and having a logic "0" state indicating that the automatically controlled rhythmation is currently in progress and a logic "1" state indicating that the automatically controlled rhythmation is currently not in use.

Figure 5:
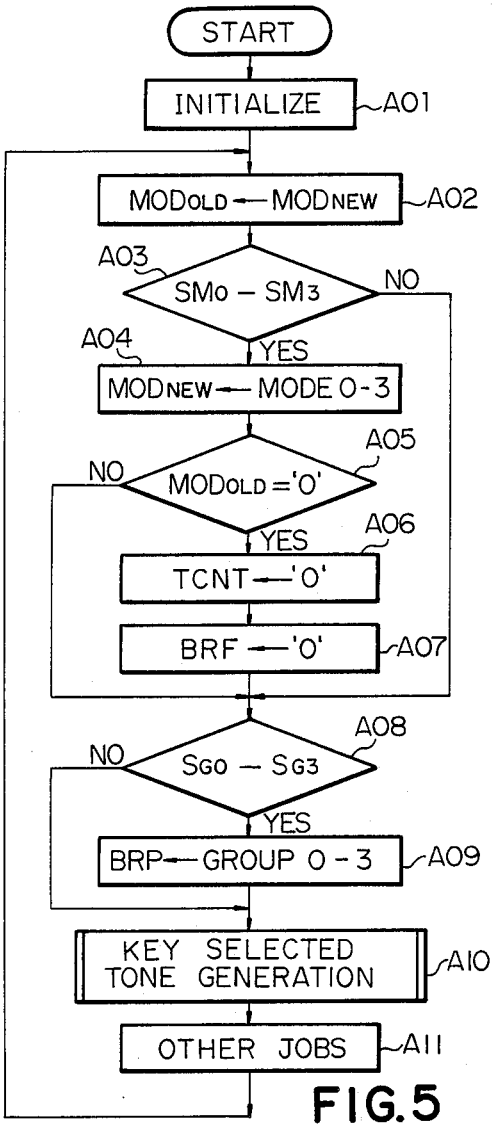
FIG. 5 is a flowchart showing the main routine program to be executed by the central processing unit included in the microcomputer which forms part of a preferred embodiment of a musical tone generator system according to the present invention.

Description will now be made in regard to the operation of the musical tone generator system embodying the present invention, first with reference to FIG. 5 which shows the main routine program to be executed by the central processing unit 58 included in the microcomputer 24 which forms part of the system shown in FIG. 1.

The main routine program is started with the power supply switch (not shown) of the system initially turned on and first proceeds to step A01 to initialize the system by clearing the contents, if any, of the registers 64 in the microcomputer 24 and storing data into the registers 64 in accordance with prescribed default rules. Upon termination of the initialization, the central processing unit 58 proceeds to step A02 to establish the new mode data $MOD_{NEW}$ in lieu of the old mode data $MOD_{OLD}$ to update the old mode data $MOD_{OLD}$. The step A02 is followed by a decision step A03 to detect whether or not there is a signal $S_{M0}$, $S_{M1}$, $S_{M2}$ or $S_{M3}$ output from the mode/group select switch circuit 42 with any one of the mode select keys 32 newly activated. This test is effected on the basis of the signals from the mode/group select switch circuit 42 and the data read from some the registers 64. If it is found at the step A03 that none of the mode select keys 32 has been newly activated, the central processing unit 58 jumps over steps A04 to A07 to another decision step A08 to check if there is a signal $S_{G0}$, $S_{G1}$, $S_{G2}$ or $S_{G3}$ output from the mode/group select switch circuit 42 with any one of the group select keys 34 newly activated. This test is effected on the basis of the signals from the mode/group select switch circuit 42 and the data read from any of the registers 64. If it is found at the step A08 that none of the group select keys 34 has been newly activated, the central processing unit 58 jumps over a step A09 to a key selected tone generation subroutine program A10 followed by a step A11 to perform jobs including the selection of the rhythm pattern. The details of this key selected tone generation subroutine program A10 will be hereinafter described with reference to FIG. 6.

Upon completion of the jobs performed at step A11, the main routine program reverts to the step A02 and further proceeds to the step A02, step A03, step A08, subroutine program A10 and step 11 until it is found at step A03 that one of the mode select keys 32 has been newly activated.

When it is thus found at step A03 that there is a signal $S_{M0}$, $S_{M1}$, $S_{M2}$ or $S_{M3}$ output from the mode/group select switch circuit 42 with one of the mode select keys 32 newly activated, then the central processing unit 58 proceeds to step A04 at which the number of the mode 0, 1, 2 or 3 of playing operation allocated to the mode select key 32 found activated is established as the new mode data $MOD_{NEW}$. Subsequently to this step A04, it is tested at step A05 whether or not the old mode data $MOD_{OLD}$ is of a logic state indicating the mode 0. If the answer for this decision step A05 is given in the negative, the central processing unit 58 jumps over the steps A06 and A07 to the step A08. If the answer for the decision step A05 is given in the affirmative, viz., it is found that the old mode data $MOD_{OLD}$ is indicative of the mode 0 selected previously, then the main routine program proceeds to step A06 to set the tempo count TCNT to a "0" state and further to step A07 to set the rhythm break flag BRF to the logic "0" state. At the step A06 is thus initialized the tempo count TCNT for the transition of the mode 0 state to the mode 1, 2 or 3 state, viz., when a shift is made from the state in which the automatically controlled rhythmation is not in progress to the state using the automatically controlled rhythmation. The break flag BRF of the logic "0" state indicates that the automatically controlled rhythmation is operable upon transition of the mode 0 state to the mode 1, 2 or 3 state.

Subsequently to the step A07 or if the answer for the decision step A05 is given in the negative, viz., it is found that the old mode data $MOD_{OLD}$ is indicative of any of the modes 1 to 3 with the mode 1, 2 or 3 selected previously, the main routine program proceeds to the decision step A08 to check if any one of the group select keys 34 has been newly activated.

When the answer for the step A08 then turns affirmative in the presence of a signal $S_{G0}$, $S_{G1}$, $S_{G2}$ or $S_{G3}$ output from the mode/group select switch circuit 42 with any one of the group select keys 34 newly activated, the central processing unit 58 proceeds from the step A08 to the step A09 at which the number of the tone group 0, 1, 2 or 3 allocated to the group select key 34 found activated is stored as the currently valid group data GRP in any of the registers 64. Through execution of this step A09, the eight different percussive tones of the tone group represented by the group data GRP are assigned as the percussive tones 0 to 7 to the eight tone-select pad key 30, respectively. Subsequently to the step A09, the main routine program proceeds to the key selected tone generation subroutine program A10 and to the step A11 and thereupon reverts to the step A02 as previously described.

The percussive tones of the group selected by one of the group select keys 34 are now generated in the mode 0, 1, 2 or 3 of playing operation selected by one of the mode select keys 32. The manner in which the percussive tones are to be thus generated varies basically from one of the modes of playing operation to another and will be for this reason hereinafter described separately for each of the modes.

(1) Mode 0

When the mode select key 32 allocated to the mode 0 of playing operation is manually activated so that there is a signal $S_{M0}$ output from the mode/group select switch circuit 42, the answer for the decision step A03 turns affirmative and the number of the mode 0 of playing operation is set as the new mode data $MOD_{NEW}$ at step A04 of the main routine program hereinbefore described with reference to FIG. 5. In the musical tone generator system is thus established the mode 0 of playing operation allowing generation of only the percussive tones designated from any of the tone-select pad key 30. Under these conditions, the central processing unit 58 controls the generation of percussive tones through execution of the key selected tone generation subroutine program A10 on the basis of the signals produced by the tone select switch circuit 40.

Figure 6A:
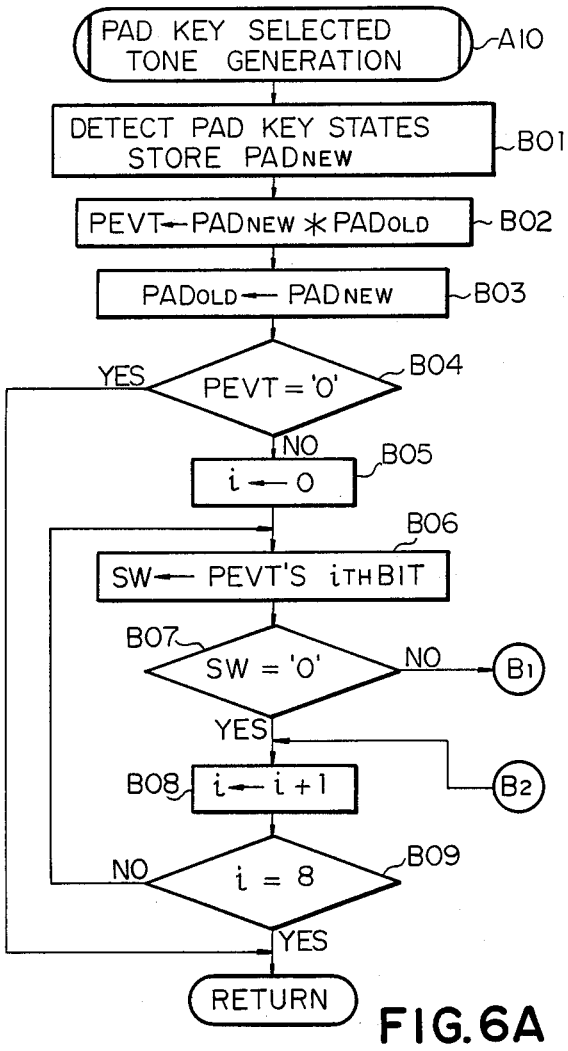
FIGS. 6A and 6B are flowcharts showing the details of the key selected tone generation subroutine program included in the main routine program illustrated in FIG. 5.
Figure 6B:
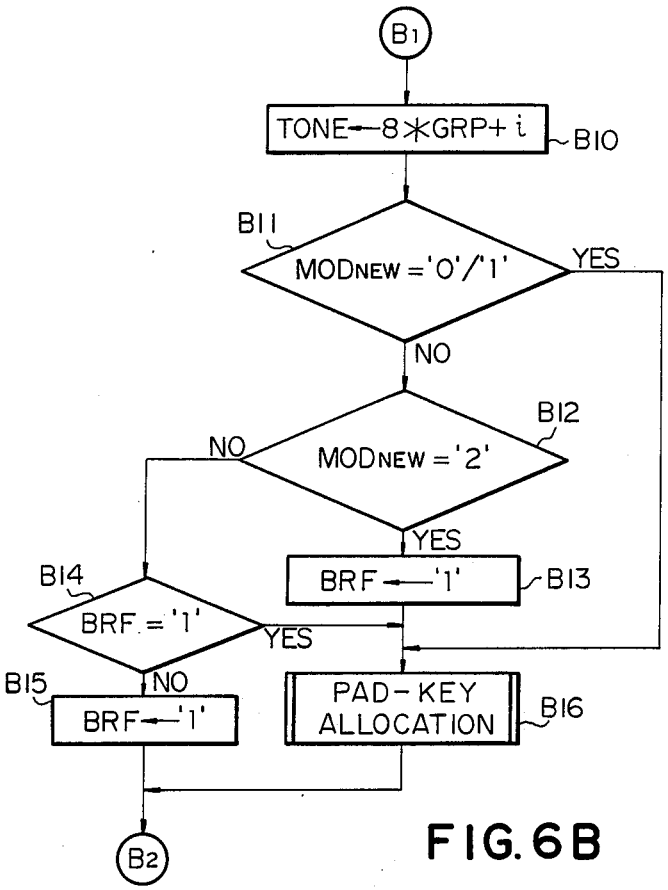

Referring to FIGS. 6A and 6B, first particularly to FIG. 6A, the key selected tone generation subroutine program A10 starts with a step B01 at which the central processing unit 58 detects the respective states of the eight tone-select pad key 30 through the tone select switch circuit 40 by way of the common bus 48. The eight-bit data representing the results of the detection is stored as the currently valid new pad-key data $PAD_{NEW}$ in any of the registers 64. Thereupon, the central processing unit 58 proceeds to B02 to invert the logic values of the individual bits forming the old pad-key data $PAD_{OLD}$ stored in any of the registers 64 and calculates the AND product of the new pad-key data $PAD_{NEW}$ and the inverted version $\overline{PAD_{OLD}}$ of the old pad-key data $PAD_{OLD}$. The AND product thus calculated is stored as the currently valid pad-key event data PEVT in any of the registers 64. It will be understood that, of the individual bits of this pad-key event data PEVT, the logic "1" bits are indicative of the tone-select pad key 30 which are newly activated after the old pad-key data $PAD_{OLD}$ was previously produced.

The step B02 is followed by a step B03 at which the new pad-key data $PAD_{NEW}$ is stored as the latest old pad-key data $PAD_{OLD}$ for use in the subsequent cycle of playing operation to detect the states of the tone-select pad key 30. It is then queried at step B04 whether or not the pad-key event data PEVT is of a logic "0" state indicating that there is no tone-select pad key 30 newly activated. If the answer for this step B04 is given in the affirmative with none of the tone-select pad key 30 newly activated, the central processing unit 58 puts an end to this key selected tone generation subroutine program A10 and reverts to the main routine program described with reference to FIG. 5.

If the answer for the step B04 is given in the negative with at least one of the tone-select pad key 30 found to be newly activated, the central processing unit 58 proceeds to step B05 to reset a variable parameter i to a logic "0" state and then executes the event data search routine formed by a loop of steps B06 to B09. The variable parameter i has eight different logic states "0" to "7" respectively corresponding to the eight digits of the pad-key event data PEVT and thus respectively indicating the eight tone-select pad key 30 with the logic state "0" of the parameter corresponding to the least significant bit (LSB) of the data PEVT and accordingly to the tone-select pad key 30 to which the percussive tone 0 is allocated. Each time the event data search routine is recycled, the variable parameter i is incremented at step B08 until it is finally confirmed at a decision step B09 that the parameter i is indicative of the most significant bit (MSB) of the pad-key event data PEVT and accordingly the tone-select pad key 30 to which the tone 7 is allocated. Each time the parameter i is thus incremented at step B08 and confirmed at step B09 to be short of a logic "7" state, the piece of data represented by the particular bit of the pad-key event data PEVT which is designated by the parameter i is detected and stored as a switch data SW of a logic "0" or "1" state at step B06 subsequent initially to the step B05 and thereafter to the decision step B09. The step B06 is followed by a step B07 to check if the switch data SW thus detected is of logic "0" state indicating that the percussive tone allocated to the tone-select pad key 30 corresponding to the bit of the pad-key event data PEVT currently designated by the parameter i is not selected for use.

When it is found at step B07 that the switch data SW is of logic "1" state indicating that the percussive tone allocated to the tone-select pad key 30 corresponding to the bit of the pad-key event data PEVT currently designated by the parameter i is selected for use, then the central processing unit 58 proceeds to a block of steps B10 to B16 shown in FIG. 6B.

Referring to FIG. 6B, the decision step B07 is now followed by a step B10 at which the tone data TONE which may be indicative of any one of the numbers respectively assigned to the thirty two different type of percussion instruments available is set to indicate percussive tone of one of the instruments. The particular percussive tone is selected from the percussive tones 0 to 7 on the basis of the currently valid variable parameter i in the tone group selected from the tone groups 0, 1, 2 and 3 on the basis of the currently valid group data GRP stored at the step A09 of the main routine program (FIG. 5). Such a tone data TONE is expressed in the form:

$$TONE=8*GRP+i$$

Subsequently to step B10, it is tested at step B11 whether or not the new mode data $MOD_{NEW}$ is of a logic "0" or "1" state. The new mode data being assumed to have already been set to be of logic "0" state at the step A04 of the main routine program (FIG. 5), the answer for this step B11 is given in the affirmative so that the central processing unit 58 skips over steps B12 and B13 and executes a pad-key allocation subroutine program B14. The details of this pad-key allocation subroutine program B14 are depicted in FIG. 7.

Figure 7:
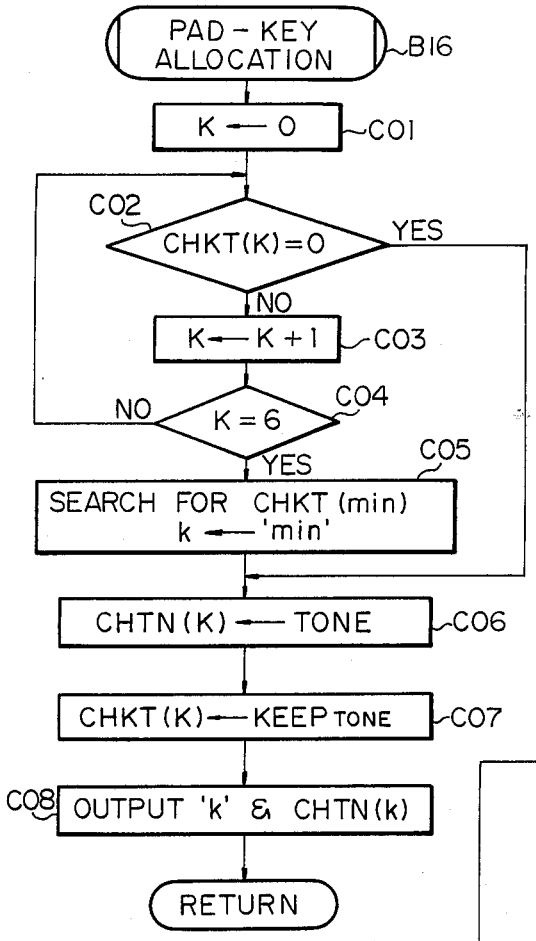
FIG. 7 is a flowchart showing the details of the pad-key allocation subroutine program included in the key selected tone generation subroutine program illustrated in FIGS. 6A and 6B.

Turning to FIG. 7, the tone-select pad key allocation subroutine program B14 starts with a step C01 at which a variable parameter k indicative of any of the six tone signal forming channels 0 to 5 available through the tone signal forming circuit 52 of the tone signal generator circuit 22 is reset to a logic "0" state designating the channel 0. Subsequently to the step C01, the channel keep interval data CHKT(0) corresponding to the tone signal forming channel 0 thus designated by the parameter k of the logic "0" state is fetched from one of the registers CHKTR shown in FIG. 4B and it is confirmed at step C02 whether or not the data CHKT(0) is of a logic "0" state.

As noted previously, the pieces of channel keep interval data CHKT(0) to CHKT(5) stored in the registers CHKTR shown in FIG. 4B are representative of the respective time durations for which percussive tones are to be generated in response to the tone signals transmitted through the tone signal forming channels of the tone signal forming circuit 52. Any of these pieces of channel keep interval data CHKT(0) to CHKT(5) is produced from one of the thirty two pieces of time interval data $KEEP_0$ to $KEEP_{31}$ fetched from the channel keep interval memory 62 as at step C06 and is reduced by one each time a timer interrupt signal is received from the timer unit 54. The operation responsive to such a signal from the timer unit 54 is performed in accordance with the timer interrupt subroutine program illustrated in FIG. 8.

Figure 8:
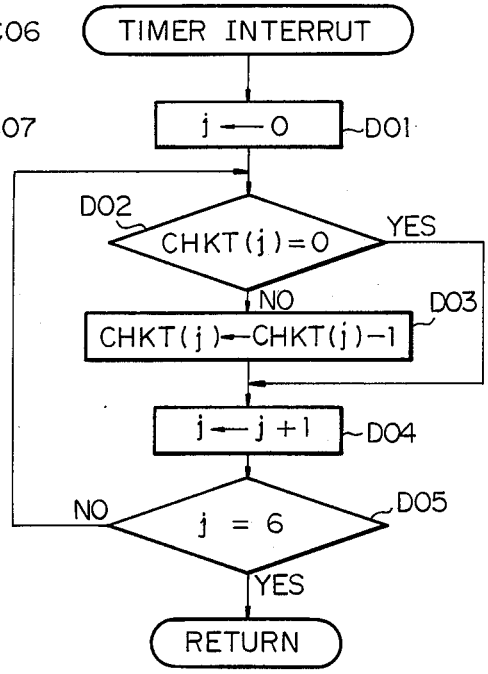
FIG. 8 is a flowchart showing the details of the timer interrupt subroutine program to be executed by the central processing unit included in the microcomputer which forms part of the musical tone generator system embodying the present invention.

Referring to FIG. 8, the central processing unit 58 starts execution of the timer interrupt subroutine program in response to a timer interrupt signal supplied from the timer unit 54. For this purpose, a variable parameter j indicative of any of the six tone signal forming channels 0 to 5 available through the tone signal forming circuit 52 is first reset to a logic "0" state at step D01. The parameter j is thereafter incremented by one through a step D04 until it is found at step D05 that the parameter j has been updated a total of five times. Each time the variable parameter j is thus incremented at step D04, it is tested at step D02 whether or not the channel keep interval data CHKT(j) is of a logic "0" state and, as long as the answer for this step D02 is given in the negative, a logic "1" value is deduced from the logic value of the channel keep interval data CHKT(j) at step D03. When it is found at step D05 that the variable parameter j has been updated a total of five times, the central processing unit 58 puts an end to the timer interrupt subroutine program. If it is found at the step D02 that the channel keep interval data CHKT(j) is of a logic "1" state, the step D02 jumps over the step D03 to the steps D04 and D05.

Reverting to FIG. 7, the channel keep interval data CHKT(0) the logic value of which is determined as hereinbefore described is tested to be of a logic "0" state as at step C02 of the pad-key allocation subroutine program B14. If it is determined at this step C02 that the channel keep interval data CHKT(0) is not of logic "0" state, the central processing unit 58 proceeds to step C03 to increment the variable parameter k by one as long as it is confirmed at step C04 that the parameter k is indicative of any one of the tone signal forming channels 1 to 5. The loop of the steps C02, C03 and C03 is thus repeated until it is found at step C02 that any one of the pieces of channel keep interval data CHKT(0) to CHKT(5) has a logic "0" state.

If it is determined at this step C02 that none of the channel keep interval data CHKT(0) is of logic "0" state, the central processing unit 58 proceeds from the step C02 to a step C05 to check into the pieces of channel keep interval data CHKT(0) to CHKT(5) to search for the channel keep interval data CHKT(min) representative of the minimum time duration. When such a channel keep interval data CHKT(min) is detected, the number "min" of the tone signal forming channel to which the the particular data is allocated is stored as the currently valid parameter k.

Subsequently to the step C05 or when it is determined at the step C02 that the channel keep interval data CHKT(0) is of the logic "0" state, the central processing unit 58 proceeds to step C06 at which the channel tone data CHTN(k) having the parameter k determined through the steps C02 to C04 or through the step step C05 is updated with the tone data TONE produced at step B10 of the subroutine program A10 (FIG. 6). This tone data TONE is indicative of one of the numbers respectively assigned to the thirty two different type of percussion instruments available as previously described. At step C07, furthermore, the channel keep interval data CHKT(k) also having the parameter k determined through the steps C02 to C04 or through the step step C05 is updated with the data $KEEP_{TONE}$ indicative of the time duration required for the generation of the percussive tone represented by the tone data TONE produced at step B10 of the subroutine program A10 (FIG. 6A). Such time interval data $KEEP_{TONE}$ is fetched from the channel keep interval memory 62 on the basis of the currently valid parameter k. Thereupon, the central processing unit 58 proceeds to step C08 at which instructions are issued so that signals indicative of the currently valid parameter k and channel tone data CHTN(k) are transferred to the tone signal generator circuit 22 by way of the common bus 48.

In response to the signal representative of the currently valid channel tone data CHTN(k) thus supplied to the tone signal generator circuit 22, the parameter data to control the generation of the percussive tone designated by the channel tone data CHTN(k) is accessed in the parameter memory 50 and is output to the tone signal forming circuit 52. The tone signal forming circuit 52 produces, on the basis of the parameter data received from the memory 50, a digital tone signal for the generation of the designated percussive tone and outputs the signal through the tone signal forming channel designated by the currently valid parameter k. In this instance, if the tone signal forming channel designated by the parameter k is currently in use for the transmission of the digital tone signal output during the preceding cycle of tone generating operation, the transmission of the signal may be interrupted to allow the newly produced digital signal to use the particular channel.

The digital tone signal thus transmitted through the tone signal forming channel designated by the parameter k is converted into an analog signal by the digital-to-analog converter 26 and the resultant analog tone signal is supplied to the sound generator system 28, which is thus enabled to generate the tone dictated by the supplied analog tone signal.

Upon termination of the step C08, the central processing unit 58 reverts to the step B08 of the subroutine program A10 illustrated in FIGS. 6A and 6B. Thus, the central processing unit 58 executes the event data search routine formed by the loop of steps B06 to B09, incrementing the variable parameter i from the logic state "1" stepwise to logic state "7" until the pad-key event data PEVT is checked for all of the eight digits thereof to prove that all of the eight tone-select pad key 30 have the logic states "0" at step B09.

Figure 9:
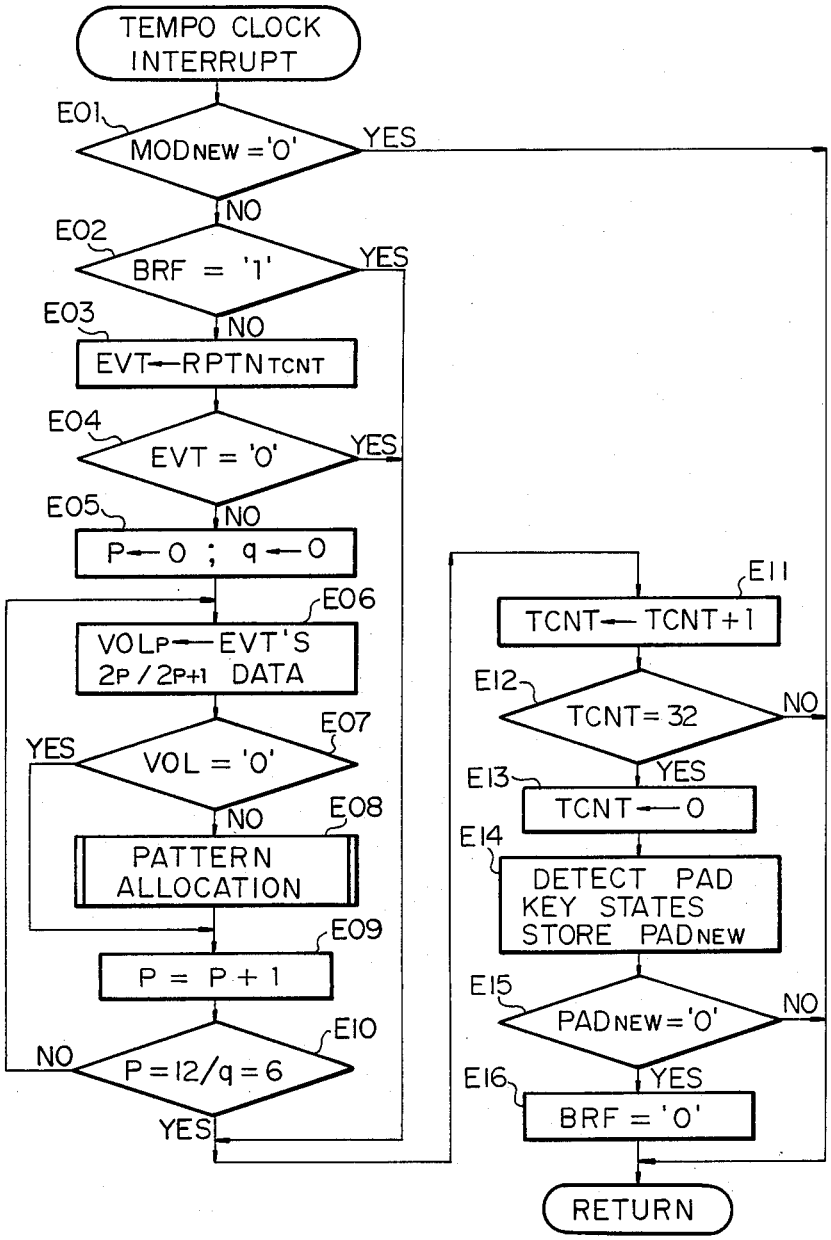
FIG. 9 is a flowchart showing the details of the tempo clock interrupt subroutine program to be executed also by the central processing unit in the musical tone generator system embodying the present invention.

When the tempo control knob 38 is manipulated and as a consequence a tempo clock signal is produced from the associated tempo clock signal generator circuit 46 during execution of the pad-key allocation subroutine program B14, the central processing unit 58 executes the tempo clock interrupt subroutine program illustrated in FIG. 9. The tempo clock interrupt subroutine program starts with a step E01 at which it is questioned whether or not the new mode data $MOD_{NEW}$ is of the logic "0" state indicating the mode 0 of playing operation currently selected. It being herein assumed that the mode 0 of playing operation is currently established and accordingly the new mode data $MOD_{NEW}$ is of the logic "0" state, the answer for this step E01 is given in the affirmative and, in this instance, the central processing unit 58 puts and end to the execution of this tempo clock interrupt subroutine program. Thus, the automatically controlled rhythmation is not effected during the mode 0 of playing operation.

As will have been understood from the foregoing description, the percussive tone designated by any of the tone-select pad key 30 and any of the group select keys 34 is allocated to one of the tone signal forming channels 0 to 5 and is generated on the basis of the signal transmitted via the particular channel through execution of the pad-key allocation subroutine program described with reference to FIG. 7. Thus, any one of the thirty two different percussive tones can be generated through use of only six tone signal forming channels 0 to 5 and, for this reason, the musical tone generator system according to the present invention can be manufactured at a significantly reduced cost as compared with prior-art systems without sacrificing the performance quality of the system. It is particularly important in the system according to the present invention that the percussive tone designated by any of the tone-select pad key 30 is allocated to any of the tone signal forming channels in accordance with the order of priority determined on the basis of the channel keep intervals for the individual percussive tones as at step C05 of the pad-key allocation subroutine program. Generation of the percussive tone which has been being generated until a new percussive tone is allocated to a selected one of the tone signal forming channels is terminated depending on the channel keep interval for the old percussive tone. This will prove useful for avoiding a situation in which generation of a percussive tone requiring a long time duration is terminated before the time duration lapses.

(2) Mode 1

When the mode select key 32 allocated to the mode 1 of playing operation is manually activated so that there is a signal $S_{M1}$ output from the mode/group select switch circuit 42, then the answer for the decision step A03 turns affirmative and the number of the mode 1 of playing operation is set as the new mode data $MOD_{NEW}$ at step A04 of the main routine program hereinbefore described with reference to FIG. 5. In the musical tone generator system is thus established the mode 1 of playing operation allowing generation of percussive tones with an automatically controlled rhythm and generation of the percussive tones designated from any of the tone-select pad key 30. Under these conditions, the central processing unit 58 also controls the generation of percussive tones through execution of the key selected tone generation subroutine program A10 on the basis of the signals produced by the tone select switch circuit 40.

During execution of the key selected tone generation subroutine program A10 with the new mode data $MOD_{NEW}$ set to indicate the mode 1 of playing operation, the answer for the step B11 querying whether or not the new mode data $MOD_{NEW}$ is of a logic "0" or "1" state is also given in the affirmative so that the central processing unit 58 executes the pad-key allocation subroutine program B14. Thus, the percussive tone designated from any of the tone-select pad key 30 is generated in substantially the same manner as in the mode 0 of playing operation.

When the tempo control knob 38 is manipulated and as a consequence a tempo clock signal is produced from the associated tempo clock signal generator circuit 46 during execution of the pad-key allocation subroutine program B14, the central processing unit 58 also executes the tempo clock interrupt subroutine program illustrated in FIG. 9. It is thus questioned at step E01 of the subroutine program whether or not the new mode data $MOD_{NEW}$ is of the logic "0" state indicating the mode 0 of playing operation currently selected. It being herein assumed that the mode 1 of playing operation is currently established and accordingly the new mode data $MOD_{NEW}$ is of the logic "1" state, the answer for this step E01 is given in the negative and, in this instance, the central processing unit 58 proceeds to step E02 to see if the rhythm break flag BRF is of a logic "1" state. The rhythm break flag BRF has been set at the step A07 of the main routine program and (also at step E16 as will be described) to be of logic "0" state indicating that the automatically controlled rhythmation is currently in progress. The answer for the step E02 is therefore given in the negative and accordingly the central processing unit 58 proceeds to a subsequent step E03. At this step E03, the central processing unit 58 references the rhythm pattern data storage section 60a of the rhythm pattern memory unit 60 (FIG. 2A) in the microcomputer 24 to fetch a rhythm pattern data $RPTN_{TCNT}$ for the rhythm pattern and tempo count TCNT currently selected and the rhythm pattern data $RPTN_{TCNT}$ thus read from the memory unit 60 is stored as an event data EVT in any of the registers 64. The step E03 is followed by a step E04 at which it is confirmed whether or not the event data EVT is of a logic "0" state. If it is found at this step E04 that the event data EVT is of the logic "0" state, the answer for the step E04 is given in the affirmative and the central processing unit 58 jumps over steps E05 to E10 to step E11 so that there is no percussive tones generated with an automatically controlled rhythm. If it happens that the answer for the step E02 is given in the affirmative, the central processing unit 58 jumps over steps E03 to E10 to the step E11 so that generation of percussive tones with an automatically controlled rhythm is inhibited. The steps E03 to E10 are to be executed for the generation of percussive tones with an automatically controlled rhythm.

If it is found at the step E04 that the event data EVT is not of the logic "0" state, the answer for the step E04 is given in the negative and in this instance the central processing unit 58 proceeds to the step E05 to reset variable parameters p and q to logic "0" states. The variable parameter p designates any one of the twelve pieces of rhythm tone data $RTND_0$ to $RTND_{11}$ (FIG. 2A) representative of the pitch notations of the twelve different types of percussion instruments, respectively, to be used in producing the rhythm pattern represented by any of the rhythm pattern data $RPTN_0$ to $RPTN_{31}$ including the rhythm pattern data $RPTN_{TCNT}$ fetched from the memory unit 60. As described previously, these twelve pieces of rhythm tone data $RTND_0$ to $RTND_{11}$ correspond to the pieces of two-bit sound volume data $VOL_0$ to $VOL_{11}$ (FIG. 2B) contained in each of the thirty two sets of rhythm pattern data $RPTN_0$ to $RPTN_{31}$. Thus, the variable parameter p further designates any one of these pieces of sound volume data $VOL_0$ to $VOL_{11}$. On the other hand, the variable parameter q designates any one of the six tone signal forming channels 0 to 5 provided in the tone signal forming circuit 52 of the tone signal generator circuit 22.

After these variable parameters p and q are thus reset to their respective "0" state at step E05, the central processing unit 58 proceeds to step E06 to extract the two pieces of data expressed by the (2p)th and (2p+1)th bits (currently 0th and 1st bits) of the event data EVT which has the 0th bit at its least significant bit (LSB) location. Thus, the purpose of this step E06 is to define the currently valid volume level data VOL by the volume level data $VOL_0$ represented by the 0th or least significant bit of the currently valid rhythm pattern data $RPTN_{TCNT}$. The two pieces of data thus extracted from the event data EVT are stored as a volume level data VOL in any of the registers 64. The step E06 is followed by a step E07 at which is confirmed whether or not the currently valid volume level data VOL is of a logic "0" state indicating that data expressed by the 0th and 1st bits of the event data EVT has a binary value "00". If it is determined at this step E07 that the currently valid volume level data VOL is of the logic "0" state, the central processing unit 58 proceeds to a pattern allocation subroutine program E08 and, if to the contrary, jumps over the subroutine program E08 to a step E09. The details of this pattern allocation subroutine program E08 are illustrated in FIG. 10.

Figure 10:
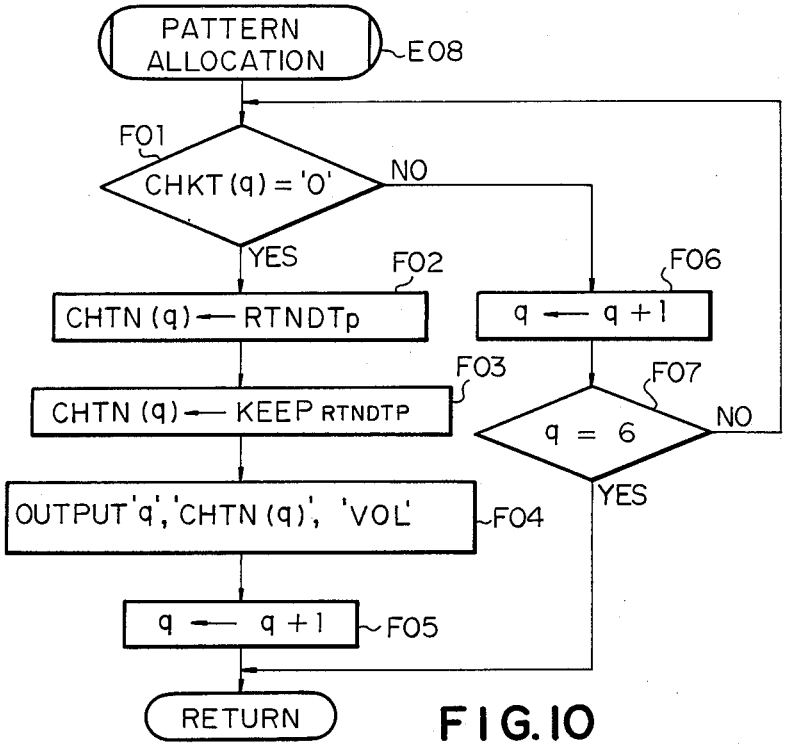
FIG. 10 is a flowchart showing the details of the pattern allocation subroutine program included in the tempo clock interrupt subroutine program illustrated in FIG. 9.

Turning to FIG. 10, the pattern allocation subroutine program E08 starts with a decision step F01 at which the channel keep interval data CHKT(q) (FIG. 4B) for the tone signal forming channel designated the variable parameter q (which is currently of logic "0" state) determined at step E05 as described above is checked if the data is of a logic "0" state. If it is found at this step F01 that channel keep interval data CHKT(q) is of the logic "0" state, the central processing unit 58 proceeds to a step F02 at which the CHTN(q) (FIG. 4A) designated the variable parameter q is defined as a currently valid rhythm tone data $RTNDT_p$ and is stored as such in any of the registers 64. Subsequently to this step F02, the channel keep interval data CHKT(q) designated by the currently valid parameter q is defined by the time interval data $KEEP_{RTNDTP}$ for the percussive tone designated by the rhythm tone data $RTNDT_p$ stored as the channel keep interval data CHKT(q) at step F02. This time interval data $KEEP_{RTNDTP}$ is fetched from the channel keep interval memory 62.

The step F03 is followed by a step F04 at which instructions are issued from the central processing unit 58 so that signals indicative of the currently valid parameter q, channel tone data CHTN(q) and volume level data VOL are transferred to the tone signal generator circuit 22 by way of the common bus 48. In response to the signal representative of the currently valid channel tone data CHTN(q) thus supplied to the tone signal generator circuit 22, the parameter data to control the generation of the percussive tone designated by the channel tone data CHTN(q) is accessed in the parameter memory 50 and is output to the tone signal forming circuit 52. The tone signal forming circuit 52 produces, on the basis of the parameter data received from the memory 50, a digital tone signal for the generation of the designated percussive tone and outputs the signal through the tone signal forming channel designated by the currently valid parameter q. In this instance, the volume level of the percussive tone to be generated is controlled on the basis of the currently valid volume level data VOL.

The digital tone signal thus transmitted through the tone signal forming channel designated by the parameter q is converted into an analog signal by the digital-to-analog converter 26 and the resultant analog tone signal is supplied to the sound generator system 28, which is thus enabled to generate the tone dictated by the supplied analog tone signal. Upon termination of the step F04, the central processing unit 58 proceeds to step F05 to increment the variable parameter q by one and then reverts to the step E09 of the tempo clock interrupt subroutine program illustrated in FIG. 9.

If it is found at the step F01 that channel keep interval data CHKT(q) is not of the logic "0" state, then the central processing unit 58 proceeds to a step F06 to increment the variable parameter q by one. The channel keep interval data(q) having a logic "0" state indicating a free signal forming channel is thus searched for until it is founed at step F07 that such tests have been effected in respect of all the channels 0 to 5 provided in the tone signal forming circuit 52. When such a free signal forming channel is found, then the central processing unit 58 executes the rhythm pattern allocation subroutine program through the sequence of steps F02 to F05 and thereupon reverts to the tempo clock interrupt subroutine program. If there is no free signal forming channel detected from the channels 0 to 5 of the tone signal forming circuit 54, the central processing unit 58 reverts from the step F07 to the tempo clock interrupt subroutine program.

As will have been understood from the foregoing description, the rhythm pattern allocation subroutine program is executed to generate tone signals when there is a free channel detected from the six tone signal forming channels 0 to 5. If there is no free channel detected from the six tone signal forming channels 0 to 5, tone signals are not generated.

Upon termination of the rhythm pattern allocation subroutine program, the central processing unit 58 proceeds to step E09 in the tempo clock subroutine program illustrated in FIG. 9 and increments the variable parameter p by one or, in this instance, from the logic "0" state to a logic "1" state. The step E09 is followed by a step E10 at which is confirmed whether or not the currently valid variable parameter meter p is of a logic "12" state or the currently valid variable parameter q is of a logic "6" state. If it is found at this step E10 that the variable parameter q is of the logic "6" state, it is determined that there is no free channel detected from the signal forming channels 0 to 5 and as such the central processing unit 58 proceeds to step E11. If it is found at the step E10 that the variable parameter q is not of the logic "6" state, it is determined that the answer for the step E10 is in the negative on the basis of the variable parameter p which has been incremented to the logic "1" at the preceding step E09, whereupon the central processing unit 58 reverts to step E06. The currently valid variable parameter p being of the logic "1" state, the central processing unit 58 extracts the pieces of data expressed by the (2p)th or 2nd and (2p+1)th or 3rd bits of the event data EVT, defining the currently valid volume level data VOL by the volume level data $VOL_1$ represented by the 1st bit of the currently valid rhythm pattern data $RPTN_{TCNT}$. The step E06 is followed by the step E07 to confirm whether or not the currently valid volume level data VOL is of a logic "0" state indicating that data expressed by the 2nd and 3rd bits of the event data EVT has a binary value "00". If it is determined at this step E07 that the currently valid volume level data VOL is of the logic "0" state, the central processing unit 58 proceeds to the pattern allocation subroutine program E08 and, if to the contrary, jumps over the subroutine program E08 to the step E09 to further increment the variable parameter p.

Through repeated execution of the loop of the steps E06 to E10, the pieces of two-bit volume level data $VOL_0$ to $VOL_{11}$ for the currently valid tempo count TCNT are thus successively read from the rhythm pattern data storage section 60*a* of the memory unit 60 to control the generation of the percussive tone currently selected. Thus, when there is detected a free tone signal forming channel, the answer for the step E10 turns affirmative when the variable parameter p is incremented up to the logic "11" state at the preceding step E09 and, in this instance, the central processing unit 58 proceeds to step E11.

At this step E11, the tempo count TCNT is incremented by one logic state and at a subsequent step E12, it is confirmed whether or not the currently valid tempo count TCNT is of a logic "32" state indicating the termination of the current measure. If it is determined at this step E12 that the currently valid tempo count TCNT is not of the logic "32", the central processing unit 58 puts an end to the tempo clock interrupt subroutine program. If it is found at the step E12 that the currently valid tempo count TCNT is of the logic "32", then the central processing unit 58 proceeds to step E13 to set the tempo count TCNT to a logic "0" and further to step E14 at which the central processing unit 58 detects the respective states of the eight tone-select pad key 30 through the tone select switch circuit 40 by way of the common bus 48. The eight-bit data representing the results of the detection is stored as the currently valid new pad-key data $PAD_{NEW}$ in any of the registers 64. At a subsequent step E15 is confirmed whether or not the currently valid new pad-key data $PAD_{NEW}$ is of a logic "0" state. If it is found at this step E15 that the currently valid new pad-key data $PAD_{NEW}$ is not of the logic "0" state, the central processing unit 58 puts an end to the tempo clock interrupt subroutine program. If it is found at the step E15 that the currently valid new pad-key data $PAD_{NEW}$ is of the logic "0" state, then the central processing unit 58 proceeds to step E16 to set the rhythm break flag BRF to the logic "0" state and thereafter puts an end to the tempo clock interrupt subroutine program. The break flag BRF is fixedly set to the logic "0" state and could not be shifted to logic "1" state during the mode 1 operation, the steps E15 and E16 of the tempo clock interrupt subroutine program are of no use in the mode 1 operation.

As will have been understood from the foregoing description, not only a sequence of percussive tones with an automatically controlled rhythm but the percussive tones designated from any of the tone-select pad key 30 are generated during the mode 1 of playing operation. In the mode 1 of playing operation, furthermore, generation of the percussive tones with the automatically controlled rhythm is inhibited by the rhythm pattern allocation subroutine program (FIG. 10) when there is no free signal forming channel in the tone signal forming circuit 52. In this instance, however, generation of the percussive tones designated from any of the tone-select pad key 30 is effected through execution of the key selected tone generation subroutine program (FIGS. 6A and 6B). The mode 1 of playing operation of the musical tone generator system according to the present invention is thus useful for enabling the player to express his or her musical intent in addition to the generation of the percussive tones with an automatically controlled rhythm.

(3) Mode 2

When the mode select key 32 allocated to the mode 2 of playing operation is manually activated so that there is a signal $S_{M2}$ output from the mode/group select switch circuit 42, then the answer for the decision step A03 turns affirmative and the number of the mode 2 of playing operation is set as the new mode data $MOD_{NEW}$ at step A04 of the main routine program hereinbefore described with reference to FIG. 5. During this mode 2 of playing operation, generation of a sequence of percussive tones with an automatically controlled rhythm is allowed until any of the tone-select pad key 30 are manually activated. When any of the tone-select pad key 30 are manually activated during generation of the sequence of percussive tones with the automatically controlled rhythm, the generation of the sequence of percussive tones with the automatically controlled rhythm is terminated at the end of the current measure for thereafter allowing generation of only the percussive tones designated from any of the tone-select pad key 30.

During execution of the key selected tone generation subroutine program A10 with the new mode data $MOD_{NEW}$ set to indicate the mode 2 of playing operation, the answer for the step B11 querying whether or not the new mode data $MOD_{NEW}$ is of a logic "0" or "1" state is given in the negative. In this instance, the central processing unit 58 proceeds from the step B11 to a step B12 to confirm whether or not the currently valid new mode data $MOD_{NEW}$ is of a logic "2". The answer for this step B12 being given in the affirmative, the central processing unit 58 then proceeds to step B13 to shift the rhythm break flag BRF to a logic "1" state and thereafter executes the pad-key allocation subroutine program B14 (FIG. 7). With the transition of the rhythm break flag BRF to the logic "1" state, the answer for the step E02 of the tempo clock interrupt subroutine program (FIG. 9) is given in the affirmative so that, if a tempo clock signal is supplied from the tempo clock signal generator circuit 46, the jumps from the step E02 to the step E11 without executing the sequence of the steps E03 to E10 which are to be executed for the generation of percussive tones with an automatically controlled rhythm.

When the tempo count TCNT is incremented to a logic "32" state at the step E11, it is determined at the subsequent step E12 that the currently valid tempo count TCNT is of the logic "32" state indicating the termination of the current measure. Thus, the central processing unit 58 proceeds to step E13 to set the tempo count TCNT to a logic "0" and further to step E14 at which the central processing unit 58 detects the respective states of the eight tone-select pad key 30 through the tone select switch circuit 40 and stores the resultant eight-bit data as the currently valid new pad-key data $PAD_{NEW}$ in any of the registers 64. At the subsequent step E15 is confirmed whether or not the currently valid new pad-key data $PAD_{NEW}$ is of a logic "0" state. If it is found at this step E15 that the currently valid new pad-key data $PAD_{NEW}$ is of the logic "0" state, then the central processing unit 58 proceeds to step E16 to set the rhythm break flag BRF to the logic "0" state indicating that none of the tone-select pad key 30 is currently activated, and thereafter puts an end to the tempo clock interrupt subroutine program. The rhythm break flag BRF being thus set to the logic "0" state at step E16, generation of percussive tones with an automatically controlled rhythm is now allowed for the subsequent measures. If it is found at the step E15 that the currently valid new pad-key data $PAD_{NEW}$ is not of the logic "0" state with any of the tone-select pad key 30 activated, the central processing unit 58 immediately puts an end to the tempo clock interrupt subroutine program. The break flag BRF being thus maintained to be of the logic "0" state, generation of percussive tones with an automatically controlled rhythm is inhibited for the subsequent measures.

As will have been understood from the foregoing description, not only a sequence of percussive tones with an automatically controlled rhythm but the percussive tones designated from any of the tone-select pad key 30 are generated during the mode 1 of playing operation. In the mode 1 of playing operation, furthermore, generation of the percussive tones with the automatically controlled rhythm is inhibited by the rhythm pattern aliocation subroutine program (FIG. 10) when there is no free signal forming channel in the tone signal forming circuit 52. In this instance, however, generation of the percussive tones designated from any of the tone-select pad key 30 is effected through execution of the key selected tone generation subroutine program (FIGS. 6A and 6B) to enable the player to express his musical intent.

As will be seen from the foregoing description that, during the mode 2 of playing operation, generation of a sequence of percussive tones with an automatically controlled rhythm is allowed unless any of the tone-select pad key 30 is manually activated. When any of the tone-select pad key 30 are manually activated during generation of the sequence of percussive tones with the automatically controlled rhythm, the generation of the sequence of percussive tones with the automatically controlled rhythm is terminated at the end of the current measure for thereafter allowing generation of only the percussive tones designated from any of the tone-select pad key 30. Thus, the mode 2 of playing operation of the musical tone generator system according to the present invention is useful for enabling the player to insert any desired kind of performance such as for example a drum solo performance into the operation generating percussive tones with an automatically controlled rhythm.

(4) Mode 3

When the mode select key 32 allocated to the mode 3 of playing operation is manually activated so that there is a signal $S_{M3}$ output from the mode/group select switch circuit 42, then the answer for the decision step A03 turns affirmative and the number of the mode 3 of playing operation is set as the new mode data $MOD_{NEW}$ at step A04 of the main routine program hereinbefore described with reference to FIG. 5. During this mode 3 of playing operation, generation of a sequence of percussive tones with an automatically controlled rhythm is allowed until any of the tone-select pad key 30 are manually activated. When any of the tone-select pad key 30 are manually activated during generation of the sequence of percussive tones with the automatically controlled rhythm, the generation of the sequence of percussive tones with the automatically controlled rhythm is terminated at the end of the current measure for thereafter allowing generation of only the percussive tones designated from any of the tone-select pad key 30.

During execution of the key selected tone generation subroutine program A10 with the new mode data $MOD_{NEW}$ set to indicate the mode 3 of playing operation, the answer for the step B12 is given in the negative so that the central processing unit 58 proceeds to step B15 to confirm whether or not the rhythm break flag BRF is of a logic "1" state. If it is found at this step B15 that the rhythm break flag BRF is of the logic "1" state indicating that the automatic rhythmation is currently not in progress, the step B15 is followed by the pad-key allocation subroutine program B14 (FIG. 7). If it is found at the step B15 that the rhythm break flag BRF is of a logic "0" state indicating that the automatic rhythmation is currently in progress, the step B15 is followed by a step B16 to shift the rhythm break flag BRF of the logic "0" state to the logic "1" state. The central processing unit 58 then proceeds to the step B08 without executing the pad-key allocation subroutine program B14 which allows generation of the percussive tones designated from any of the tone-select pad key 30.

The rhythm break flag BRF having shifted to the logic "1" state at step B16, the answer for the step B15 is given in the affirmative if any of the tone-select pad key 30 is manually activated and as a consequence, the pad-key allocation subroutine program B14 is executed subsequently to the step B15 to allow generation of the percussive tones designated from any of the tone-select pad key 30.

As will have been seen from the foregoing description, the mode 3 of playing operation of the musical tone generator system according to the present invention is used during the mode 2 of playing operation to inhibit generation of the percussive tone designated by the first activated one of the tone-select pad key 30. If any of the tone-select pad key 30 is manually activated while the automatically controlled rhythmation is in progress with the mode 3 of operation established, the percussive tone designated by the particular tone-select pad key 30 is not generated although the percussive tones designated from the tone-select pad key 30 which may be thereafter activated are generated. If the player desires to have percussive tones generated through manipulation of the tone-select pad key 30 with the automatically controlled rhythmation inhibited at the beginning of a measure, he may activate any of the tone-select pad key 30 toward the end of the immediately preceding measure so that generation of the percussive tone at the first beat in the current measure is inhibited if the player activates any of the tone-select pad key 30 with a somewhat delayed timing at the beginning of the current measure.

While a sole preferred embodiment of the musical tone generator system according to the present invention has been hereinbefore described, it should be borne in mind that such an embodiment of the present invention is simply by way of example and may thus be changed and modified in various manners, examples of such modifications being as follows:

(1) It has been assumed that the percussive tones designated from the tone-select pad key 30 are to be generated with a fixed volume level but, if desired, the volume level of the tones designated from the tone-select pad key 30 may be varied depending on the speeds and/or pressures of the manipulative efforts applied to the tone-select pad key 30. This can be realized through provision of touch sensors responsive to such speeds and pressures and will provide added accents in the tones produced through manipulation of the tone-select pad key 30 and will thus improve the performance quality of the musical tone generator system according to the present invention.

(2) While, furthermore, the rhythm pattern memory unit 60 is assumed to be implemented by a read-only memory having the rhythm pattern data preliminarily stored therein, such a memory unit may be substituted by a random-access memory into which any rhythm pattern data may be stored from appropriate programming keys provided on the control board 20 and/or from any external source of data. This allows the use of various and any desired automatically controlled rhythms.

(3) While it has been assumed that the channel keep intervals for the generation of percussive tones of different percussion instruments are respectively fixed for the individual instruments, such intervals may be varied depending on the volume levels of the percussive tones to be generated. For this purpose, the channel keep interval data $KEEP_0$ to $KEEP_{31}$ read from the channel keep interval memory 62 (FIG. 3) may be weighted depending on the volume level data VOL when the channel keep interval data CHKT(0) to CHKT(5) are to be stored into the channel keep interval data registers CHKTR (FIG. 4B). Where arrangements are made so that the volume level of the tones designated from the tone-select pad key 30 are be varied through provision of touch sensors associated with the tone-select pad key 30 as above noted, the channel keep interval data $KEEP_0$ to $KEEP_{31}$ may be weighted depending on the data produced on the basis of the signal supplied from the touch sensors.

(4) It has been described that the allocation of the percussive tones to be generated on automatically controlled rhythmation is allowed only when it is confirmed that the channel keep interval data CHKT is of the logic "0" state. If desired, however, such allocation may be allowed when the time duration represented by the channel keep interval data CHKT is found to be less than a predetermined limit value. The allocation of the percussive tones to be generated on automatically controlled rhythmation and the allocation of the percussive tones to be generated through manipulation of the tone-select pad key 30 may be controlled through detection of the volume levels of the percussive tones generated without having recourse to the use of the channel keep interval data CHKT.

(5) It has been assumed that the percussive tones of all the types of percussion instruments available are indiscriminately allocated to any of the signal forming channels. In view, however, of the fact that percussive tones of, for example, high-hat cymbals open and high-hat cymbals closed will not be generated concurrently, the respective signal forming channels to which the tones of such instruments have already been allocated are searched for to have these tones allocated to one and the same signal forming channel. Likewise, when the tone-select pad key 30 assigned to a common instrument are manually activated, the percussive tones to be generated may be allocated to a single channel.

Figure 11:
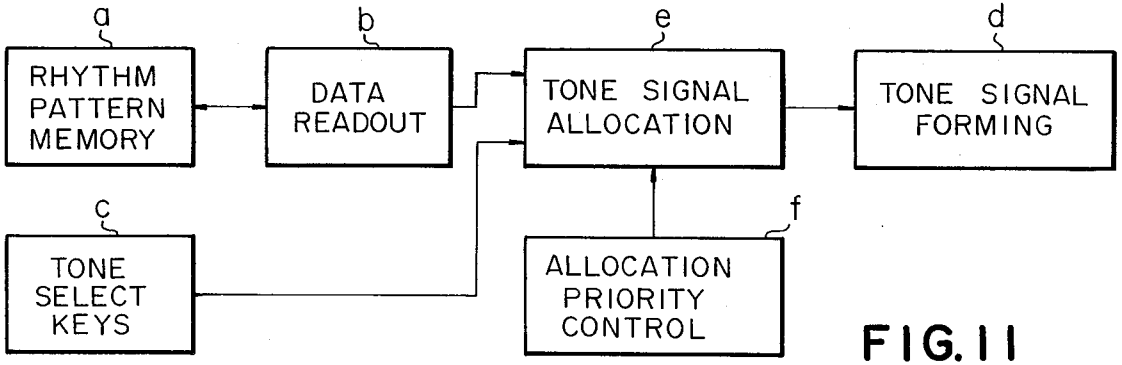
FIG. 11 is a block diagram showing the basic arrangement of a musical tone generator system according to a first outstanding aspect of the present invention.

In accordance with a first important aspect of the present invention, there is provided a musical tone generator system comprising, as schematically illustrated in FIG. 11, a rhythm pattern memory "a" (60) having stored therein rhythm pattern data ($RPTN_0$–$RPTN_{31}$) representative of a plurality of different rhythm patterns for automatically generating a plurality of musical tones in a selected one of the rhythm patterns, pattern data readout means "b" (E03) for reading the rhythm pattern data from the rhythm pattern data successively for the different rhythm patterns at predetermined timings, a plurality of tone select keys "c" (30) respectively corresponding to the plurality of musical tones each for producing a signal instructing the generation of the tone to which the tone select key corresponds, tone signal forming means "d" (52) having a plurality of tone signal forming channels (0–5), the tone signal forming means being operative to form in and output from each of the tone signal forming channels a tone signal which is specified by the rhythm pattern data read by the data readout means or which corresponds to the tone designated by an activated one of the tone select keys, tone signal allocating means "e" (B14; E08) for controlling the formation of the tone signal specified by the rhythm pattern data read by the data readout means or corresponding to the tone designated by the activated one of the tone select keys by allocating the tone signal to one of the tone signal forming channels, and allocation priority control means "f" (B13; E02) for controlling the allocation of the tone signal corresponding to the tone designated by the activated one of the tone select keys and the tone signal specified by the rhythm pattern data read by the data readout means so that the former is allocated to one of the tone signal forming channels preferentially over the latter.

When the pieces of rhythm pattern data ($RPTN_0$–$RPTN_{31}$) are read out from the rhythm pattern memory "a" (60) successively by the pattern data readout means "b" (E03), the tone signal allocating means "e" (B14; E08) controls the formation of the tone signal specified by the rhythm pattern data read by the data readout means by allocating the tone signal to one of the tone signal forming channels. The tone signal forming means "d" (52) is thus enabled to form in and output from each of the tone signal forming channels a tone signal which is specified by the rhythm pattern data read by the data readout means with the result that a sequence of tones is automatically generated from the tone signal forming means "d" in accordance with the pieces of rhythm pattern data read out from the rhythm pattern memory "a". When any one of the tone select keys "e" is manually activated under this condition, tone signal allocating means "e" controls the formation of the tone signal corresponding to the tone designated by the activated one of the tone select keys by allocating the tone signal to one of the tone signal forming channels. The tone signal forming means "d" is thus enabled to form in and output from each of the tone signal forming channels a tone signal which corresponds to the tone designated by the activated tone select key. In these manners, the tone signal forming means "d" is operative to generate a sequence of tones with an automatically controlled rhythm pattern and the tone designated by the activated tone select key.

The allocation priority control means "f" (B13; E02) controls the allocation of the tone signal corresponding to the tone designated by the activated one of the tone select keys and the tone signal specified by the rhythm pattern data read by the data readout means so that the former is allocated to one of the tone signal forming channels preferentially over the latter. When one of the tone select keys "c" is activated, the tone designated by the tone select key is generated preferentially over the tones with the automatically controlled rhythmation.

Figure 12:
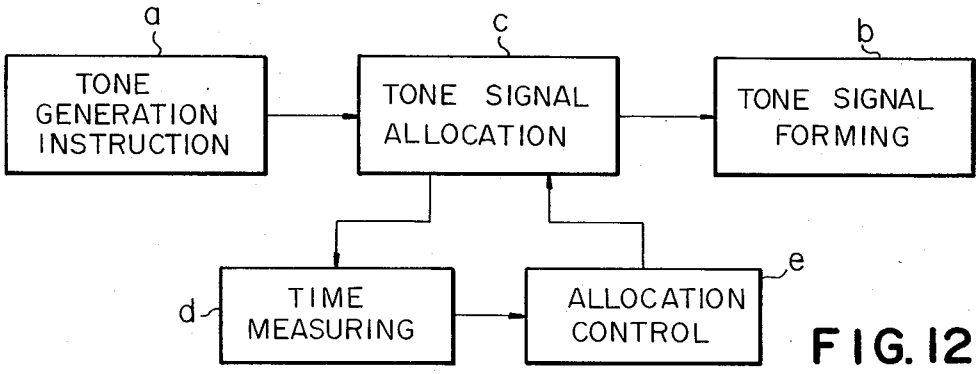
FIG. 12 is a block diagram showing the basic arrangement of a musical tone generator system according to a second outstanding aspect of the present invention.

In accordance with a second important aspect of the present invention, there is provided a musical tone generator system comprising, as schematically illustrated in FIG. 12, tone generation instructing means "a" (30; 40; 60; E03) operable for instructing selective generation of a plurality of different kinds of musical tones, tone signal forming means "b" (52) having a plurality of tone signal forming channels (0–5), the tone signal forming means being operative to form in and output from each of the tone signal forming channels a tone signal which corresponds to the tone designated by an activated one of the tone select keys, tone signal allocating means "c" ($CH_0$–$CH_5$; B14; E03) for controlling the formation of the tone signal corresponding to the tone designated by the activated one of the tone select keys by allocating the tone signal to one of the tone signal forming channels, time measuring means "d" (62; CHKTR; C01–C04) respectively corresponding to the tone signal forming channels for measuring the residual time duration for which the generation of the tone being generated under the control of the tone signal is to be continued, the residual time duration being measured for each of the different kinds of musical tones, and allocation control means "e" (C05–C08) for controlling the allocation of the tone signal corresponding to the tone designated by the activated one of the tone select keys, the allocation of the tone signal being controlled on the basis of the residual time duration measured by the time measuring means.

Figure 13:
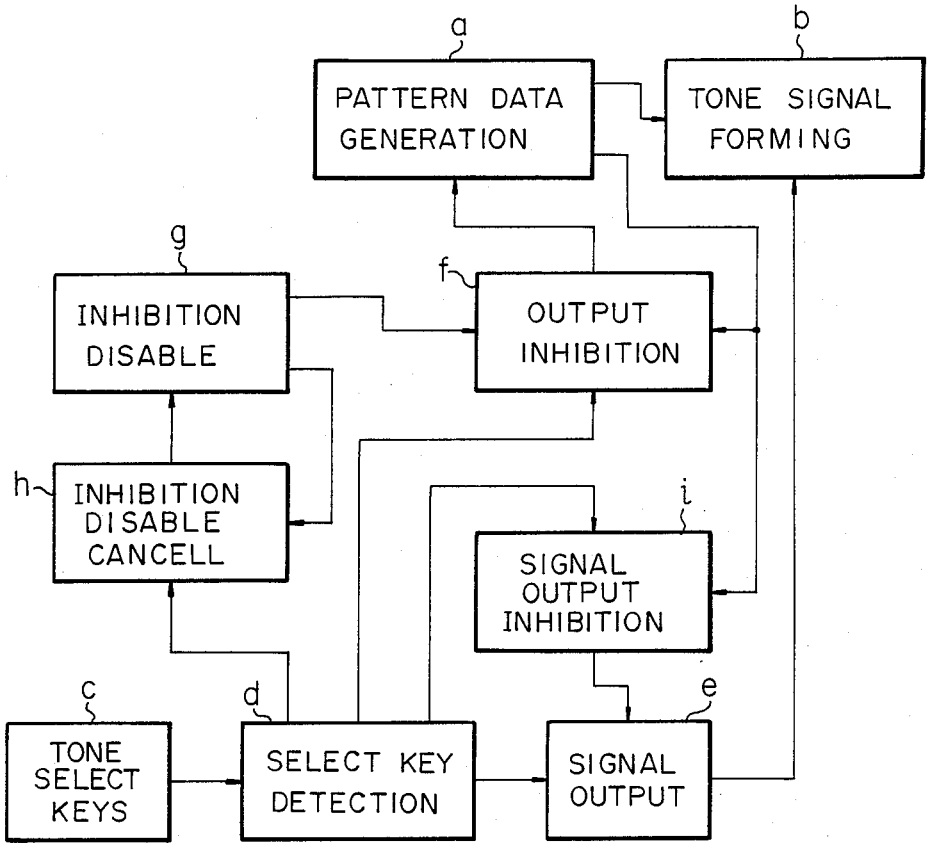
FIG. 13 is a block diagram showing the basic arrangement of a musical tone generator system according to a third outstanding aspect of the present invention.

In accordance with a third important aspect of the present invention, there is provided a rhythm tone generator system comprising, as schematically illustrated in FIG. 13, rhythm pattern data generating means "a" (60) for outputting rhythm pattern data ($RPTN_0$–$RPTN_{31}$) successively at predetermined timings, the rhythm pattern data being representative of a plurality of different rhythm patterns of a plurality of musical tones to be automatically generated, percussive tone signal forming means "b" (52) responsive to the rhythm pattern data output from the rhythm pattern data generating means for forming percussive tone signals dictated by the rhythm pattern data received, a plurality of tone select keys "c" (30) respectively corresponding to the plurality of musical tones each for producing a signal instructing the generation of the tone to which the tone select key corresponds, tone select key detecting means "d" (40) for detecting the respective states of the tone select keys and producing signals representative of the detected states of the tone select keys, signal output means "e" (58) for outputting the signals from the tone select key detecting means to the percussive tone signal forming means for controlling the formation of the percussive tone signals, signal output inhibiting means "f" responsive to the signals from the tone select key detecting means for inhibiting the rhythm pattern data generating means from outputting the rhythm pattern data if the rhythm pattern data generating means is in the process of outputting the rhythm pattern data, and inhibition disabling means "g" for disabling the signal output inhibiting means at predetermined timings.

In accordance with a fourth important aspect of the present invention, there is provided a rhythm tone generator system comprising, as also schematically illustrated in FIG. 13, rhythm pattern data generating means "a" (60) for outputting rhythm pattern data ($RPTN_0$–$RPTN_{31}$) successively at predetermined timings, the rhythm pattern data being representative of a plurality of different rhythm patterns of a plurality of musical tones to be automatically generated, percussive tone signal forming means "b" (52) responsive to the rhythm pattern data output from the rhythm pattern data generating means for forming percussive tone signals dictated by the rhythm pattern data received, a plurality of tone select keys "c" (30) respectively corresponding to the plurality of musical tones each for producing a signal instructing the generation of the tone to which the tone select key corresponds, tone select key detecting means "d" (40) for detecting the respective states of the tone select keys and producing signals representative of the detected states of the tone select keys, signal output means "e" (58) for outputting the signals from the tone select key detecting means to the percussive tone signal forming means for controlling the formation of the percussive tone signals, signal output inhibiting means "f" responsive to the signals from the tone select key detecting means for inhibiting the rhythm pattern data generating means from outputting the rhythm pattern data if the rhythm pattern data generating means is in the process of outputting the rhythm pattern data, inhibition disabling means "g" for disabling the signal output inhibiting means at predetermined timings, and inhibition disable cancelling means "h" for cancelling the disabled state of the signal output inhibiting means when a signal is produced from the signal output means with the signal output inhibiting means held in the disabled state.

In accordance with a fifth important aspect of the present invention, there is provided a rhythm tone generator system comprising, as also schematically illustrated in FIG. 13, rhythm pattern data generating means "a" (60) for outputting rhythm pattern data ($RPTN_0$–$RPTN_{31}$) successively at predetermined timings, the rhythm pattern data being representative of a plurality of different rhythm patterns of a plurality of musical tones to be automatically generated, percussive tone signal forming means "b" (52) responsive to the rhythm pattern data output from the rhythm pattern data generating means for forming percussive tone signals dictated by the rhythm pattern data received, a plurality of tone select keys "c" (30) respectively corresponding to the plurality of musical tones each for producing a signal instructing the generation of the tone to which the tone select key corresponds, tone select key detecting means "d" (40) for detecting the respective states of the tone select keys and producing signals representative of the detected states of the tone select keys, signal output means "e" (58) for outputting the signals from the tone select key detecting means to the percussive tone signal forming means for controlling the formation of the percussive tone signals, signal output inhibiting means "f" responsive to the signals from the tone select key detecting means for inhibiting the rhythm pattern data generating means from outputting the rhythm pattern data if the rhythm pattern data generating means is in the process of outputting the rhythm pattern data, inhibition disabling means "g" for disabling the signal output inhibiting means at predetermined timings, and inhibition disable cancelling means "i" which, when a signal is produced from the signal output means, inhibits the signal output means from outputting a signal if the rhythm pattern data generating means is in the process of outputting the rhythm pattern data.

What is claimed is:

1. A musical tone generator system comprising (a) a rhythm pattern memory having stored therein rhythm pattern data representative of a plurality of different rhythm patterns for automatically generating a plurality of musical tones in a selected one of said rhythm patterns, (b) pattern data readout means for reading the rhythm pattern data from said rhythm pattern memory successively for said different rhythm patterns at predetermined timings, (c) a plurality of tone select keys respectively corresponding to said plurality of musical tones each for producing a signal instructing the generation of the tone to which the tone select key corresponds, (d) tone signal forming means having a plurality of tone signal forming channels, said tone signal forming means being operative to form in and output from each of said tone signal forming channels a tone signal which is specified by the rhythm pattern data read by said data readout means or which corresponds to the tone designated by an activated one of said tone select keys, (e) tone signal allocating means for controlling the formation of the tone signal specified by the rhythm pattern data read by said data readout means or corresponding to the tone designated by said activated one of said tone select keys by allocating said tone signal to one of said tone signal forming channels, and (f) allocation priority control means for controlling the allocation of the tone signal corresponding to the tone designated by said activated one of said tone select keys and the tone signal specified by the rhythm pattern data read by said data readout means so that the former is allocated to one of said tone signal forming channels preferentially over the latter.

2. A musical tone generator system as set forth in claim 1, in which said musical tones are of percussive tones of prescribed percussion instruments and in which said tone signal forming means is operative to form tone signals respectively representative of said percussive tones.

3. A musical tone generator system as set forth in claim 1, in which said allocation priority control means comprises (f-1) first allocation control means operative to control said tone signal allocating means so that, when any of said tone select keys is activated, the tone signal corresponding to the tone designated by the activated tone select key is to be compulsively allocated to one of said tone signal forming channels, and (f-2) second allocation control means operative to control said tone signal allocating means so that, when said rhythm pattern data is read by said data readout means, the tone signal specified by the rhythm pattern data read by said data readout means is allocated to a particular one of said tone signal forming channels, said particular one of said tone signal forming channels being the channel in which said tone signal has been completely formed or is about to be 4. A musical tone generator system comprising (a) tone generator instructing means operable for instructing selective generation of a plurality of different kinds of musical tones, (b) tone signal forming means having a plurality of tone signal forming channels, said tone signal forming means being operative to form in and output from each of said tone signal forming channels a tone signal which corresponds to the tone designated by said tone generation instructing means, (c) tone signal allocating means for controlling the formation of the tone signal corresponding to the tone designated by said tone generation instructing means by allocating said tone signal to one of said tone signal forming channels, (d) time measuring means respectively corresponding to said tone signal forming channels for measuring the residual time duration for which the generation of the tone being generated under the control of said tone signal is to be continued, said residual time duration being measured for each of said different kinds of musical tones, and (e) allocation control means for controlling the allocation of the tone signal corresponding to the tone designated by said tone generation instructing means, the allocation of the tone signal being controlled on the basis of the residual time duration measured by said time measuring means.

5. A musical tone generator system as set forth in claim 4, in which said tone generation instructing means comprises (a-1) a plurality of tone select keys respectively corresponding to said plurality of musical tones, and (a-2) instruction signal generating means respectively provided in association with said tone select keys for producing a signal instructing the generation of the tone to which each of said the tone select keys corresponds.

6. A musical tone generator system as set forth in claim 4, in which said tone generation instructing means comprises (a-3) a rhythm pattern memory having stored therein rhythm pattern data representative of a plurality of different rhythm patterns for automatically generating any of said musical tones in a selected one of said rhythm patterns, and (a-4) data readout means for reading the rhythm pattern data from said rhythm pattern data successively for said different rhythm patterns at predetermined timings.

7. A musical tone generator system as set forth in claim 4, in which said tone signal allocating means comprises (e-1) a plurality of memory channels respectively associated with said tone signal forming channels, (e-2) memory control means by which the data represented by the musical tone specified by said tone generation instructing means is to be stored into any of said memory channels under the control of said allocation control means, and (e-3) output means for transferring to said tone signal forming means said data stored into any of said memory channels.

8. A musical tone generator system as set forth in claim 4, in which said time measuring means comprises (d-1) a tone generation interval data storage memory storing tone generation interval data respectively representative of said different kinds of musical tones, and (d-2) counting means respectively associated with said tone signal forming channels and operative to measure said residual time duration, said counting means measuring said residual time duration by using said tone generation interval data as an initial data and successively updating the initial data at predetermined time intervals.

9. A musical tone generator system as set forth in claim 4, in which said allocation control means comprises channel select control means for selecting a particular one of the tone signal forming channels which remain free with no tone signal allocated thereto, said particular one of the tone signal forming channels being selected as the channel to which the tone signal corresponding to the musical tone designated by said tone generation instructing means.

10. A musical tone generator system as set forth in claim 4, in which said allocation control means comprises channel select control means for selecting a particular one of the tone signal forming channels to which are allocated the tone signals corresponding to the musical tones having the residual time durations less than a predetermined value, said particular one of the tone signal forming channels being selected as the channel to which the tone signal corresponding to the musical tone designated by said tone generation instructing means.

11. A musical tone generator system as set forth in claim 4, in which said allocation control means comprises channel select control means for selecting a particular one of the tone signal forming channels, the residual time duration of the musical tone corresponding to the tone signal allocated to said particular one tone signal forming channel being less than the residual time durations of the musical tones corresponding to the tone signals allocated to all of the other tone signal forming channels, said particular one of the tone signal forming channels being selected as the channel to which the tone signal corresponding to the musical tone designated by said tone generation instructing means.

12. A rhythm tone generator system comprising
(a) rhythm pattern data generating means for outputting rhythm pattern data successively at predetermined timings, said rhythm pattern data being representative of a plurality of different rhythm patterns of a plurality of musical tones to be automatically generated,
(b) percussive tone signal forming means responsive to the rhythm pattern data output from said rhythm pattern data generating means for forming percussive tone signals dictated by the rhythm pattern data received,
(c) a plurality of tone select keys respectively corresponding to said plurality of musical tones each for producing a signal instructing the generation of the tone to which the tone select key corresponds,
(d) tone select key detecting means for detecting the respective states of said tone select keys and producing signals representative of the detected states of the tone select keys,
(e) signal output means for outputting the signals from said tone select key detecting means to said percussive tone signal forming means for controlling the formation of said percussive tone signals,
(f) signal output inhibiting means responsive to the signals from said tone select key detecting means for inhibiting said rhythm pattern data generating means from outputting said rhythm pattern data if the rhythm pattern data generating means is in the process of outputting the rhythm pattern data, and
(g) inhibition disabling means for disabling said signal output inhibiting means at predetermined timings.

13. A musical tone generator system as set forth in claim 12, in which said predetermined timings correspond to timing at which said rhythm pattern data begin to be output from said rhythm pattern data generating means.

14. A rhythm tone generator system comprising
(a) rhythm pattern data generating means for outputting rhythm pattern data successively at predetermined timings, said rhythm pattern data being representative of a plurality of different rhythm patterns of a plurality of musical tones to be automatically generated,
(b) percussive tone signal forming means responsive to the rhythm pattern data output from said rhythm pattern data generating means for forming percussive tone signals dictated by the rhythm pattern data received,
(c) a plurality of tone select keys respectively corresponding to said plurality of musical tones each for producing a signal instructing the generation of the tone to which the tone select key corresponds,
(d) tone select key detecting means for detecting the respective states of said tone select keys and producing signals representative of the detected states of the tone select keys,
(e) signal output means for outputting the signals from said tone select key detecting means to said percussive tone signal forming means for controlling the formation of said percussive tone signals,
(f) signal output inhibiting means responsive to the signals from said tone select key detecting means for inhibiting said rhythm pattern data generating means from outputting said rhythm pattern data if the rhythm pattern data generating means is in the process of outputting the rhythm pattern data,
(g) inhibition disabling means for disabling said signal output inhibiting means at predetermined timings, and
(h) inhibition disable cancelling means for cancelling the disabled state of said signal output inhibiting means when a signal is produced from said signal output means with said signal output inhibiting means held in the disabled state.

15. A musical tone generator system as set forth in claim 14, in which said predetermined timings correspond to timings at which said rhythm pattern data begin to be output from said rhythm pattern data generating means.

16. A rhythm tone generator system comprising
(a) rhythm pattern data generating means for outputting rhythm pattern data successively at predetermined timings, said rhythm pattern data being representative of a plurality of different rhythm patterns of a plurality of musical tones to be automatically generated,
(b) percussive tone signal forming means responsive to the rhythm pattern data output from said rhythm pattern data generating means for forming percussive tone signals dictated by the rhythm pattern data received,
(c) a plurality of tone select keys respectively corresponding to said plurality of musical tones each for producing a signal instructing the generation of the tone to which the tone select key corresponds,
(d) tone select key detecting means for detecting the respective states of said tone select keys and producing signals representative of the detected states of the tone select keys,
(e) signal output means for outputting the signals from said tone select key detecting means to said percussive tone signal forming means for controlling the formation of said percussive tone signals,
(f) signal output inhibiting means responsive to the signals from said tone select key detecting means for inhibiting said rhythm pattern data generating means from outputting said rhythm pattern data if the rhythm pattern data generating means is in the process of outputting the rhythm pattern data,
(g) inhibition disabling means for disabling said signal output inhibiting means at predetermined timings, and
(i) inhibition disable cancelling means which, when a signal is produced from said signal output means, inhibits said signal output means from outputting a signal if said rhythm pattern data generating means is in the process of outputting the rhythm pattern data.

17. A musical tone generator system as set forth in claim 16, in which said predetermined timings correspond to timings at which said rhythm pattern data begin to be output from said rhythm pattern data generating means.

18. A rhythm tone generator system comprising
(a) rhythm pattern data generating means for outputting rhythm pattern data representative of a rhythm pattern to be automatically generated,
(b) percussive tone signal forming means for forming a percussive tone signal on the basis of said rhythm pattern data, (c) a plurality of tone select keys respectively corresponding to a plurality of predetermined musical tones each for producing a tone signal designating the musical tone to which the tone select key corresponds, (d) tone signal supply means for supplying said tone signal to said percussive tone signal forming means and thereby enabling the percussive tone signal forming means to generate another percussive tone signal representative of the musical tone designated by any of said tone select keys, (e) first inhibiting means responsive to the tone signal supplied from said tone signal supply means for inhibiting said rhythm pattern data generating means from outputting said rhythm pattern data on condition that the rhythm pattern data generating means is in the process of outputting the rhythm pattern data, and (f) second inhibiting means responsive to the tone signal produced by any of said tone select keys for inhibiting said tone signal supply means from supplying the tone signal to said percussive tone signal forming means on condition that said rhythm pattern data generating means is in the process of outputting the rhythm pattern data, whereby said tone signal supply means is inhibited from generating said another percussive tone signal when the tone select key is activated for the first time and is allowed to generate said another percussive tone signal when the tone select key is activated after the key is activated for the first time.

* * * * *